US011186006B2

(12) United States Patent
Sanderson

(10) Patent No.: US 11,186,006 B2
(45) Date of Patent: Nov. 30, 2021

(54) TUBE PERFORATING MACHINE

(71) Applicant: Sanpro Industries Limited, Lower Hutt (NZ)

(72) Inventor: Ronald Malcolm Bond Sanderson, Lower Hutt (NZ)

(73) Assignee: SANPRO INDUSTRIES LIMITED, Lower Hutt (NZ)

( * ) Notice: Subject to any disclaimer, the term of this patent is extended or adjusted under 35 U.S.C. 154(b) by 0 days.

(21) Appl. No.: 16/801,958

(22) Filed: Feb. 26, 2020

(65) Prior Publication Data

US 2020/0290232 A1 Sep. 17, 2020

(30) Foreign Application Priority Data

Feb. 26, 2019 (NZ) ..... 751058

(51) Int. Cl.
*B26F 1/00* (2006.01)
*B26F 1/14* (2006.01)

(52) U.S. Cl.
CPC ..... *B26F 1/0023* (2013.01); *B26F 1/14* (2013.01)

(58) Field of Classification Search
CPC ..... B26F 1/0023; B26F 1/14; B26F 1/02
See application file for complete search history.

(56) References Cited

U.S. PATENT DOCUMENTS 3,990,827 A * 11/1976 Maroschak ..... B26F 1/0015 425/150
5,953,974 A * 9/1999 Hegler ..... B26D 7/02 83/206
7,013,778 B1 * 3/2006 Lupke ..... B23D 21/00 29/896.6
10,556,359 B2 * 2/2020 Jacobs ..... A43D 999/00
2002/0139228 A1 * 10/2002 Johnston ..... B26D 7/08 83/13
2005/0051009 A1 * 3/2005 Sanderson ..... B21D 28/28 83/401
2008/0282865 A1 * 11/2008 Sanderson ..... B21D 28/28 83/669
2010/0083803 A1 * 4/2010 Sanderson ..... B26F 1/0061 83/36
2010/0119333 A1 * 5/2010 Lemens ..... B26F 1/02 412/6

* cited by examiner

*Primary Examiner* — Omar Flores Sanchez
(74) *Attorney, Agent, or Firm* — Franklin & Associates International Inc; Matthew F. Lambrinos

(57) ABSTRACT

The invention relates to tube perforating machine for perforating a hollow tube. The powered machine includes a mechanical timing system comprising a Geneva mechanism so that perforations are punched when the tube is held stationary and perforations cannot be punched when the tube is rotating or moving longitudinally within the machine.

25 Claims, 16 Drawing Sheets

100

1
604a
600
4
2
10
3

FIG. 3
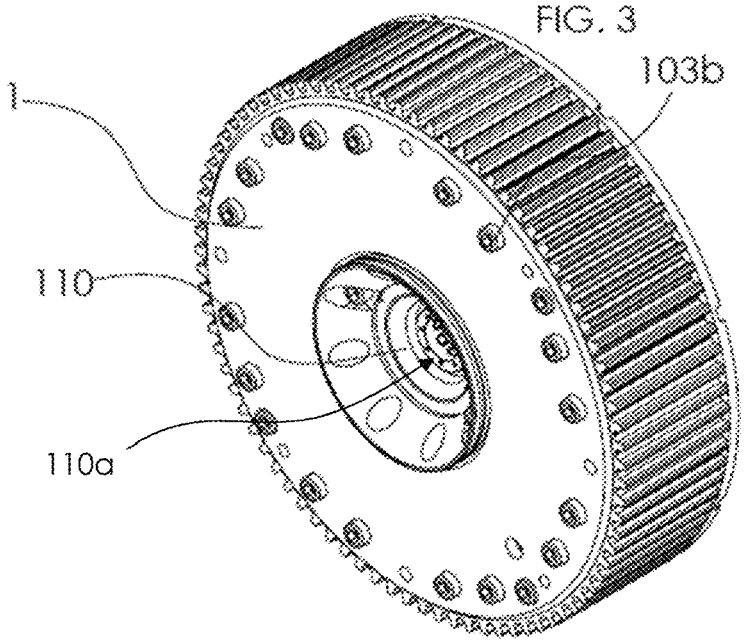
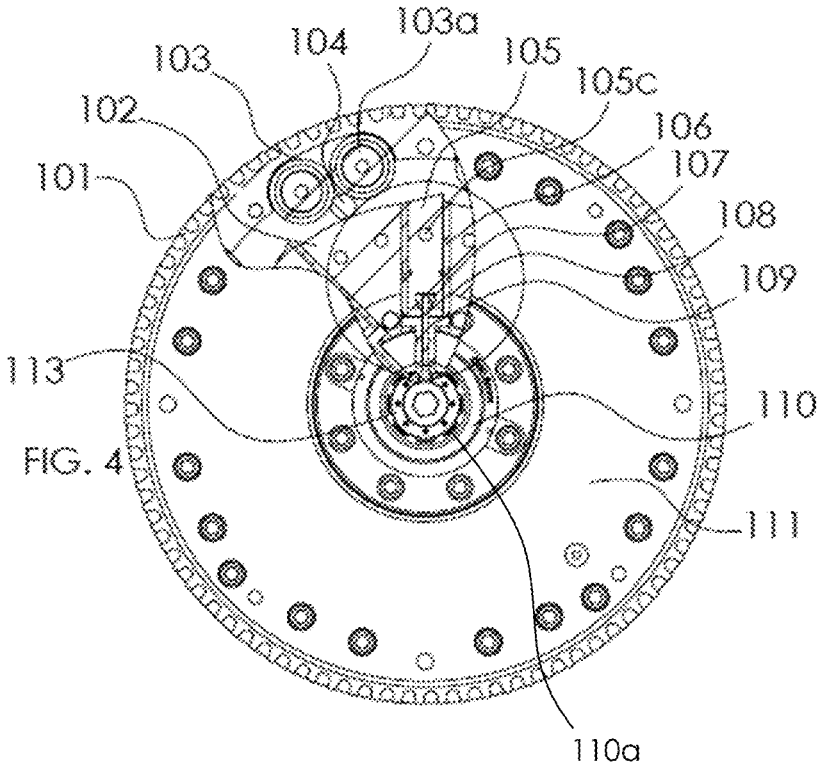
FIG. 4

105a
105
105c
106
107
108
109
109a
114
113
106a
140
106c
106b
106e
105b
109b
108a 105a
105
105c
106
107
108
109
109a
114
113
106a
140
109a
109c
113a

503

506
502
507
504
508
501
403
509

800
801

TUBE PERFORATING MACHINE

CROSS REFERENCE TO RELATED APPLICATIONS

This application claims the benefit of priority of New Zealand Patent Application No. 751058, filed on Feb. 26, 2019, the entire contents of which are incorporated herein by reference.

BACKGROUND

Field of the Invention

The present disclosure generally relates to a tube perforating machine.

Description of the Related Art

In this specification where reference has been made to patent specifications, other external documents, or other sources of information, this is generally to provide a context for discussing features of the invention. Unless specifically stated otherwise, reference to such external documents or sources of information is not to be construed as an admission that such documents or such sources of information, in any jurisdiction, are prior art or form part of the common general knowledge in the art.

SUMMARY OF THE INVENTION

In a first aspect, the invention provides a tube perforating machine for perforating a hollow tube. The machine comprises a drive motor and a punch head powered by the drive motor. The punch head comprises: an actuator hub comprising an annulus for receiving the tube and also comprising one or more tube perforating sets, each tube perforating set comprising a clamp, a clamp actuator, a punch and a punch actuator. Each tube perforating set is housed within an actuator housing located in the actuator hub and is able to move between an engaged position in which the clamp presses against the tube when located in the annulus and the punch punches through the tube, and a disengaged position in which the clamp and punch both release contact with the tube. The punch head also comprises a rotating mechanical cam assembly comprising an annulus within which the actuator hub is received and also comprising a rotatable member engaged with one or more travel rollers. The travel rollers are configured to engage and disengage with the clamp actuator and punch actuator as the rotatable member rotates about the actuator hub, to move the clamp and punch between the engaged and disengaged positions. The machine further comprises a timing system powered by the motor and comprising a Geneva mechanism comprising a Geneva drive wheel and a Geneva driven wheel; and a carriage mounted on a linear frame, the carriage being configured to move along the length of the tube. The timing system is operatively connected to the rotating mechanical cam assembly of the punch head by a rotational drive system and is also operatively connected to the carriage by an axial drive system to move the carriage along the length of the tube when each perforating set is in the disengaged position.

In a second aspect, the invention provides a tube perforating machine for perforating a hollow tube. The machine comprises a drive motor and a punch head powered by the drive motor. The punch head comprises: an actuator hub comprising an annulus for receiving the tube and also comprising one or more tube perforating sets, each tube perforating set comprising a clamp, a clamp actuator, a punch and a punch actuator. Each tube perforating set is housed within an actuator housing located in the actuator hub and is able to move between an engaged position in which the clamp presses against the tube when located in the annulus and the punch punches through the tube, and a disengaged position in which the clamp and punch both release contact with the tube. The punch head also comprises a rotating portion comprising an annulus within which the actuator hub is received. The rotating portion is configured to engage and disengage with the clamp actuator and punch actuator to move the clamp and punch between the engaged and disengaged positions. The machine further comprises a timing system powered by the motor and comprising a Geneva mechanism operatively connected to the carriage to move the carriage along the length of the tube when each perforating set is in the disengaged position.

In one form, the actuator hub comprises a replaceable tube guide within its annulus, the tube guide being configured to receive the tube and guide the tube into the machine.

The actuator housings may each be defined by a first aperture, provided in an inner wall of the tube guide, a second aperture provided in a circular outer peripheral surface of the actuator hub, and a hollow space extending between the first and second apertures.

Typically, each perforating set also comprises a punch holder that holds the punch and engages with the punch actuator to move the punch from a disengaged position to an engaged position.

Preferably, the actuator hub comprises eight actuator housings, spaced equidistant about the actuator hub, and eight perforating sets, each set being located in one of the actuator housings.

The radial drive system may comprise a first drive wheel that is rotated by the motor and a drive belt operatively engaged with the first drive wheel and the rotating member to transmit rotational motion from the first drive wheel to the rotating mechanical cam assembly of the punch head. Preferably, the rotating member is a ring gear.

Preferably, the first drive wheel is operatively connected to the Geneva drive wheel to rotate the Geneva drive wheel simultaneously with the first drive wheel as the rotating mechanical cam assembly of the punch head rotates.

In one form, the Geneva drive wheel comprises one or more outwardly facing curved bearing surfaces and one or more gaps located between the bearing surfaces, wherein an engagement member is located within each of the gaps; wherein the Geneva driven wheel comprises an outwardly facing surface comprising one or more scalloped regions and a projection between adjacent scalloped regions, wherein a radial opening extends from a maximum point of each projection toward a central point of the Geneva driven wheel; and wherein each opening of the Geneva driven wheel is configured to slidingly receive one of the engagement members of the Geneva drive wheel. Preferably, the radial openings define channels formed in a rear surface of the Geneva driven wheel.

In one form, the Geneva drive wheel comprises four bearing surfaces, a gap between each of the bearing surfaces, and an engagement member located within each gap.

Preferably, the Geneva driven wheel comprises four projections and four scalloped regions to form a Maltese cross shape.

In one form, the axial drive system comprises an axial drive shaft that is operatively connected to the Geneva driven wheel; a first pulley; a second pulley; and a radial drive belt that is operatively connected to the first and second pulleys. Preferably, the first pulley is a radial drive pulley and the second pulley is a radial driven pulley, both of which are engaged with the radial drive belt so that rotation of the radial drive pulley causes rotation of the radial driven pulley. Preferably, the radial drive pulley and the radial driven pulley rotate in a 2:1 ratio.

In one form, the axial drive system further comprises a radial drive system that engages with the carriage to move the carriage along the length of the tube. Preferably, the radial drive system comprises a ball spline, a carriage driving gear and a carriage driven gear.

In one form, the carriage comprises a chuck comprising a plurality of collets, and a chuck shroud having a tapered interior surface.

In one form, the ball spline engages with the carriage driving gear, which engages with the carriage driven gear, which engages with the chuck to rotate the chuck as the radial drive pulley rotates. Preferably, the chuck rotates 22.5° for every 90° rotation of the radial drive pulley.

In one form, the axial drive system further comprises a third pulley, a fourth pulley and a linear drive belt, wherein the linear drive belt is operatively connected to the second, third and fourth pulleys so that rotation of the second pulley causes rotation of the linear drive belt and the third and fourth pulleys. Preferably, the third pulley is a linear drive pulley and the fourth pulley is a linear driven pulley.

In one form, the third and fourth pulleys are interchangeable with third and fourth pulleys of different tooth counts to change the linear pitch of the machine.

Preferably, the axial drive system further comprises a ball screw having a longitudinal axis extending between the front and rear of the machine, and wherein the fourth pulley engages with the ball screw to rotate the ball screw as the fourth pulley rotates.

Optionally, the axial drive system further comprises a half nut, attached to the carriage, and a ball screw air ram, wherein the ball screw air ram is adapted to engage with the half nut and cause the half nut to engage with the ball screw to move the half nut and carriage along the rotating ball screw. Preferably, the ball screw air ram is energised by a time delay relay.

In one form, the carriage comprises a chuck air ram, a chuck yoke having a first end and a second end and being configured to pivot about a yoke pivot located on the carriage, and a chuck ram shaft configured to engage with bearing members at the second end of the chuck yoke, wherein the chuck air ram is energisable to push the first end of the chuck yoke away from the carriage, causing the chuck yoke to pivot about the yoke pivot and push the chuck ram shaft against the internal surface of the chuck shroud. Preferably, the chuck air ram is energised by a time delay relay.

In one form, the chuck rotates the tube when each perforating set is in the disengaged position.

In one form, the carriage is mounted on a frame and wherein the machine further comprises a carriage backstop that slides along and is lockable in relation to the frame to selectively adjust the position of the carriage in relation to the punch head. Preferably, the carriage backstop comprises a clamping handle operative to rotate in one direction to clamp the backstop in position on the frame and to rotate in an opposite direction to release the backstop.

In one form, the machine further comprises a proximity sensor operatively connected with the motor to cut power to the motor and de-energise the air rams via a time delay relay when the carriage reaches a predetermined distance from the punch head.

Preferably, the machine further comprises a die comprising a plurality of bores, wherein each bore in the die corresponds with a punch in the punch head, and wherein the diameter of each bore corresponds to the diameter of the respective punch plus a clearance based on the thickness of the material of the tube to be perforated. Preferably, the tube has an internal diameter and the die has an external diameter that is smaller than the internal diameter of the tube.

This invention may also be said broadly to consist in the parts, elements and features referred to or indicated in the specification of the application, individually or collectively, and any or all combinations of any two or more said parts, elements or features. Where specific integers are mentioned herein which have known equivalents in the art to which this invention relates, such known equivalents are deemed to be incorporated herein as if individually described.

The term 'comprising' as used in this specification and claims means 'consisting at least in part of'. When interpreting statements in this specification and claims that include the term 'comprising', other features besides those prefaced by this term can also be present. Related terms such as 'comprise' and 'comprised' are to be interpreted in a similar manner.

As used herein the term '(s)' following a noun means the plural and/or singular form of that noun. As used herein the term 'and/or' means 'and' or 'or', or where the context allows, both.

BRIEF DESCRIPTION OF THE DRAWINGS

Embodiments will now be described by way of example only and with reference to the accompanying drawings in which:

FIG. 3 is an isometric view of one form of punch head that may be used with the tube perforating machine of the invention;

FIG. 4 is an illustrative cutaway front view of the punch head of FIG. 3;

DETAILED DESCRIPTION

Various embodiments and methods of use will now be described with reference to FIGS. 1 to 16

The tube perforating machine 100 of the invention is configured to receive and hold a tube 800 and to perforate the tube with holes 801 located and arranged according to a tube specification for that particular tube. A tube specification for a tube will specify the perforation pattern to be applied to that tube, the tube diameter, tube length, tube wall thickness, material type, punch diameter, and various dimensional tolerances. Tube specifications may differ between tubes to satisfy the different uses of tubes. For example, the number of rows/rings of perforations may vary, the distance between rows may vary, the rows may start and/or end at different locations along the tube, the number of holes within each row may vary, the spacing between holes within a row may vary and holes within adjacent rows may lie adjacent to each other or offset from each other. The tube perforating machine of the invention is able to create perforations in tubes that take into account all of these variations in perforation patterns using a mechanical arrangement that controls the linear and/or rotational movement of the tube within the machine.

Figure 1:
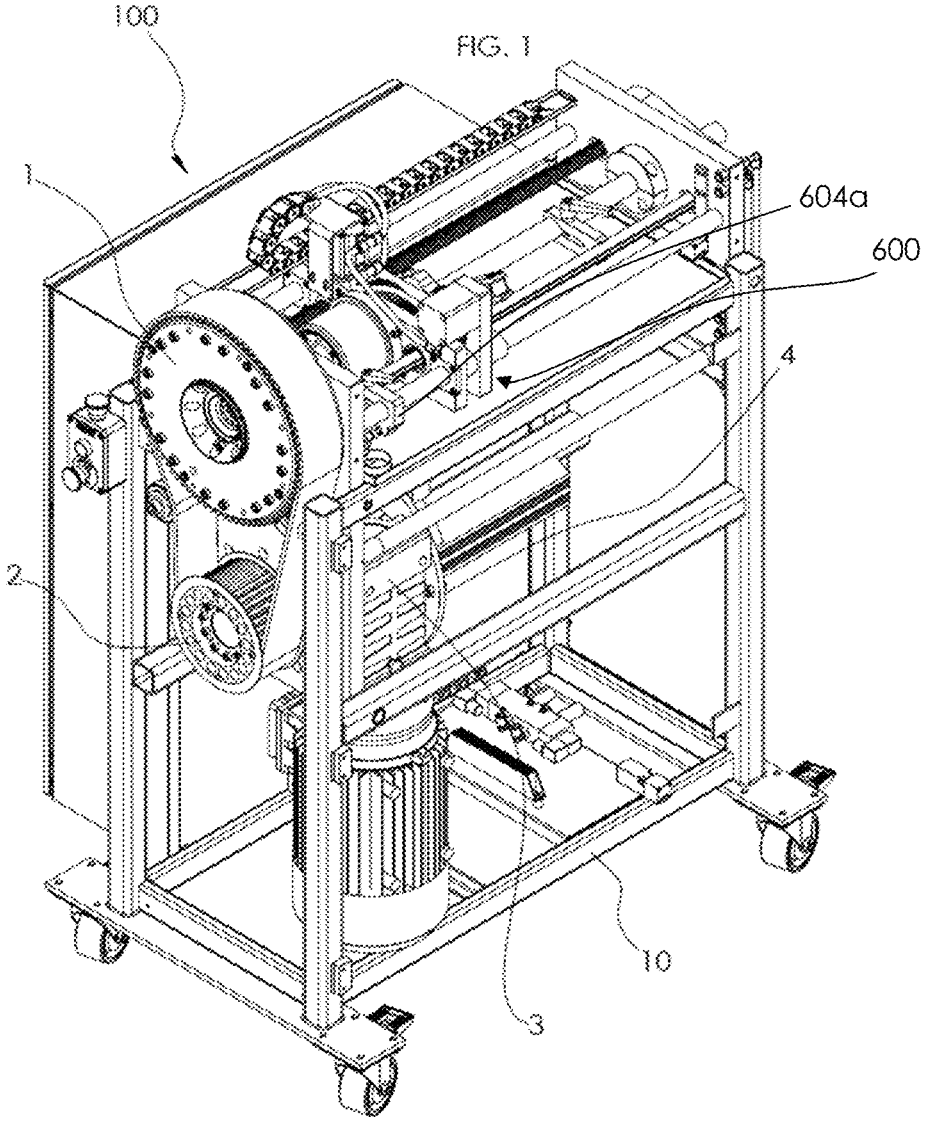
FIG. 1 is an isometric view showing one form of tube perforating machine from the front in which the cover of the machine has been removed.
Figure 2:
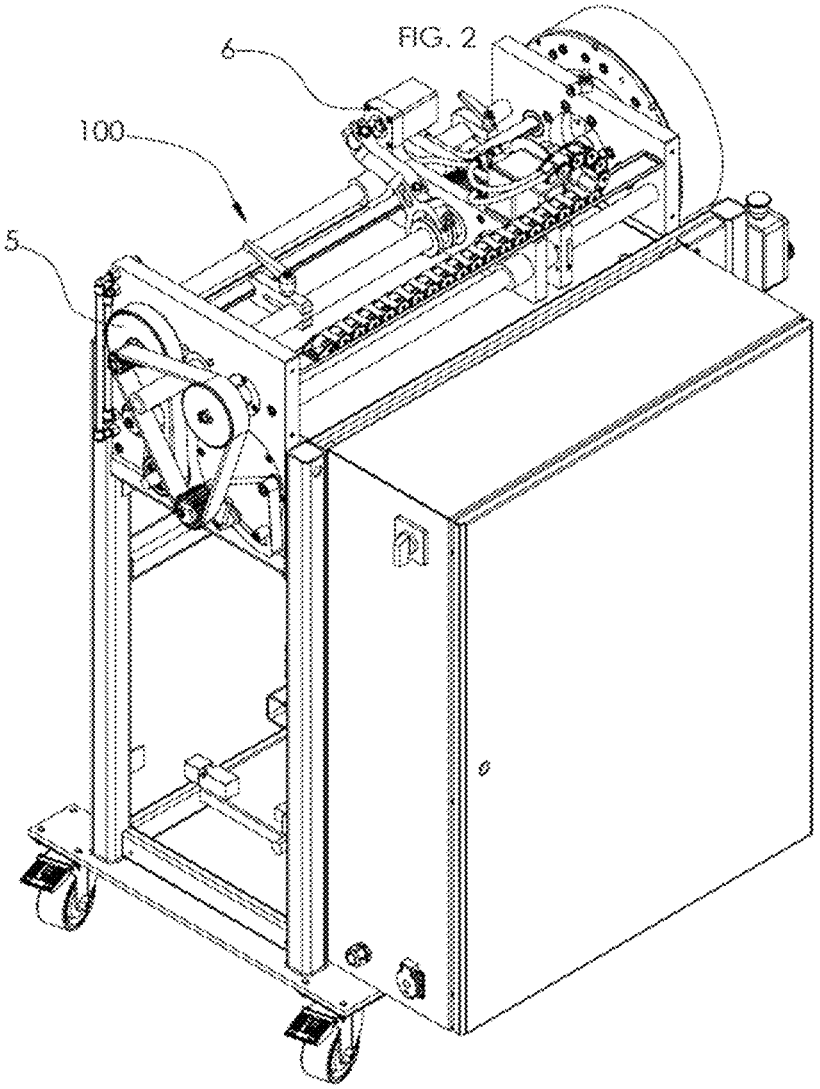
FIG. 2 is an isometric view of the machine of FIG. 1 from the rear.

FIGS. 1 and 2 show one form of tube perforating machine according to the invention. The machine 100 comprises a drive system, a feed system and a perforation system, each of which comprise component parts that are supported by a machine frame 10. The frame may comprise a front plate, located at the front of the machine, and a rear plate located at the rear of the machine 100. The machine 100 may also comprise a cover (not shown) fitted with isolating switches to conform to international safety specifications.

Component parts that are supported by the frame 10 include a punch head 1, a radial drive system 2, a power system 3, a mechanical timing system 4, an axial drive system 5, and a carriage 6.

The power system 3 comprises a drive motor and a gearbox. The tube perforating machine 100 may be operated by a single drive motor. The motor is connected to the radial drive system 2, which comprises a rotating first drive wheel 201 and a drive belt 202 to operatively connect the rotational drive to a rotating portion, such as a rotating mechanical cam assembly of the punch head 1. The motor is configured to rotate the rotating first drive wheel 201, which in turn rotates the drive belt 202, causing a rotating cam assembly 15 of the punch head 1 to rotate simultaneously with the first drive wheel 201 and the drive belt 202.

The punch head 1 is typically located at one end of the machine 100. In the embodiments shown in FIGS. 1-2, the punch head 1 is located at the front end of the machine 100. The punch head 1 comprises a front plate 111, a back plate 112, and a body having a rotating portion and a stationary portion. The stationary portion comprises an actuator hub 102, one or more actuator housings 140 and a tube guide 110 comprising an annular aperture/annulus 110*a* that is located generally centrally within the front plate of the punch head 1. The tube guide annulus 110*a* is configured to receive a tube 800 to be perforated therein. Each actuator housing 140 is configured to receive a perforating set comprising various component parts to hold a tube 800 in place within the punch head 1 and to perforate the tube 800.

In one embodiment, the tube guide 110 is configured as a two piece assembly, comprising a front half 110*a* and back half 110*b*. The two piece assembly provides for expedited tool changes to be made by allowing the component parts of the perforating sets to be readily accessible by separating the front half 110*a* from the back half 110*b* of the tube guide. Tool changes may be desirable when parts become worn or broken or to allow for different tube specifications to be met, such as by allowing for the punch head to support a different number of punches and therefore to create a different number of holes within a tube during each punch cycle, or to receive a tube of a different diameter, material thickness, or to create different sized perforation holes in the tube based on the provided tube specification.

The actuator hub 102 is typically attached to the front plate of the machine frame 10. The tube guide 110 is configured to receive a tube 800 to be perforated, by pushing the tube through the annulus 110*a* and into the machine 100. The annulus 110*a* is defined by an inner wall of the tube guide 110, as shown in FIGS. 3 and 4. In preferred embodiments, the tube guide 110 is removable so that a user can selectively replace the tube guide with one that has an annulus 110*a* of a desired diameter. This arrangement allows a user to select a tube guide 110 depending on the diameter of the tube 800 to be perforated.

The tube guide 110 is configured to receive the tube 800 within the machine. The punch head 1, along with a tube positioning system 600 comprising a carriage 6 and a chuck 601, is configured to temporarily hold the tube 800 in a non-rotating position within the tube guide 110, and perforate the tube 800 with a series of holes 801 that extend around the circumference of the tube in a row to form a ring of holes. Tube specifications may determine the diameter of a tube, the number of rows of holes to be made in the tube, the number of holes in each row, the spacing between rows and the angle between holes in adjacent rows and the diameter of holes for example.

The punch head 1 and chuck 601 are configured to hold the tube 800 firmly within the tube guide 110 to prevent rotation of the tube as holes are being punched in the tube. To hold the tube 800 in a non-rotating position, the punch head 1 comprises one or more tube clamps 109, each having an associated clamp actuator 106 to cause the respective clamp to clamp against the tube in an engaged position and to retract away from the tube in a disengaged position.

The punch head 1 is also configured to perforate the tube 800. To perforate the tube 800, the punch head 1 comprises one or more punch holders 107, each having an associated punch actuator 105 and an associated punch 108. In a preferred embodiment, the punch head 1 comprises eight tube clamps 109, eight clamp actuators 106, eight punch holders 107, eight punch actuators 105 and eight punches 108 to form up to 8 holes 801 in a row.

A tube clamp 109 and an associated clamp actuator 106, punch holder 107, punch actuator 105 and punch 108 together form a perforating set. Each perforating set is located within a respective actuator housing 140 formed in the actuator hub 102 of the punch head. The tube perforating machine 100 shown in FIGS. 4 and 4A, therefore includes eight perforating sets located within eight respective actuator housings 140. However, it is envisaged that the actuator hub 102 may comprise any suitable number of one or more perforating sets, such as three sets, six sets, or ten sets for example. Typically, the perforating sets and therefore the actuator housings 140 should be spaced generally equidistantly around the tube guide 110 or may be arranged in sets, such as in pairs, that are spaced generally equidistantly around the tube guide 110.

The tube guide 110 and the actuator hub 102 of the punch head 1 are preferably generally cylindrical in shape, having a circular outer peripheral surface. The rotating portion of the punch head 1 may comprise a rotating mechanical cam assembly 15 that comprises a circular sleeve comprising a ring gear 101 that is connected to the front and back plates 111, 112 of the punch head 1. The ring gear is configured to surround the actuator hub 102 and rotate about the circular periphery of the actuator hub. The rotating cam assembly 15 is configured to engage with the actuator hub 102 to cause the perforating sets to engage and disengage with the tube 800 (in order to clamp and perforate the tube and then to release the tube) when the tube 800 is located at the desired position within the tube guide 110.

The actuator hub 102 and a single actuator housing 140 will now be described in further detail and by way of example only. However, it should be appreciated that the actuator hub 102 will comprise multiple actuator housings 140, each configured to receive a perforating set. Preferably, the actuator hub 102 comprises at least two actuator housings 140, each with a perforating set and being generally spaced equidistant about the annulus 110*a* of the tube guide 110. As can be seen from FIGS. 4 and 4A, the actuator hub 102 comprises a first aperture that is provided in the inner wall of the tube guide 110 and a second aperture that is provided in the circular outer peripheral surface of the actuator hub 102. A hollow space is provided between the first and second apertures 120, 130 to define an actuator housing 140. A punch actuator 105 is at least partially located in the clamp actuator 106, which is held within the actuator housing 140. The punch actuator 105 includes an angled distal end 105*a* that at least partially projects beyond the second aperture when the punch 108 is in a retracted position, as shown in FIG. 4. The proximal end 105*b* of the punch actuator 105, which is located opposite its distal end 105*a*, is configured to operatively engage with the respective punch 108. In one embodiment, the proximal end 105*b* of the punch actuator 105 engages with a punch holder 107, which is attached to or is configured to engage with a punch 108. The punch holder 107 may be any suitable holder to hold the punch in operative engagement with the punch actuator 105. For example, the punch holder may comprise a threaded aperture located in the proximal end of the punch actuator 105 and with which a threaded distal end of the punch 108 may be engaged. In another embodiment, the punch 108 is configured to slide within an aperture or recess formed in the punch holder 107, and may be fixed in place with a fastener, such as a grub screw or similar.

Each punch holder 107 is preferably held in a T-slot formed in the respective punch actuator 105 and is centred within the respective clamp actuator 106. The punch actuator 105, and therefore also the punch holder 107 and the punch 108, is able to move longitudinally between the first and second apertures 120, 130 of the actuator housing 140 so as to move between an engaged position, when the punch actuator has moved toward the first aperture 120 to its maximum extent, and an disengaged position, when the punch actuator has moved toward and through the second aperture 130 to its maximum extent.

Figure 4A:
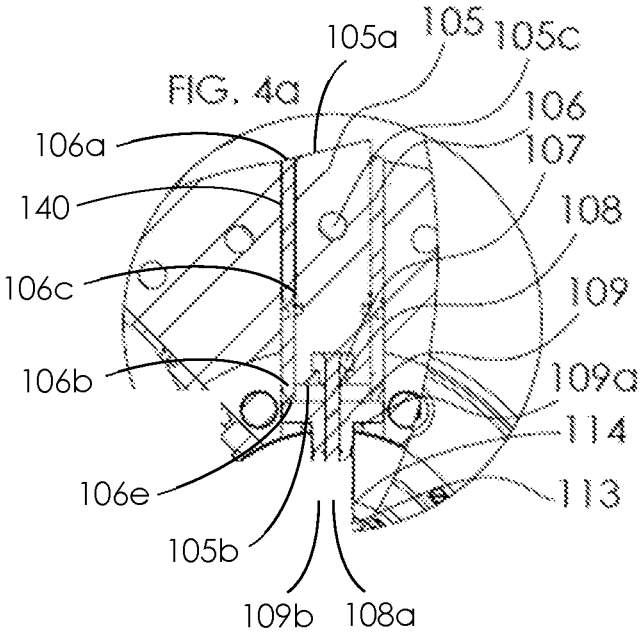
FIG. 4*a* is an enlarged illustrative cutaway view of the punch head of FIG. 4, in which the perforating system is in the release position.
Figure 4B:
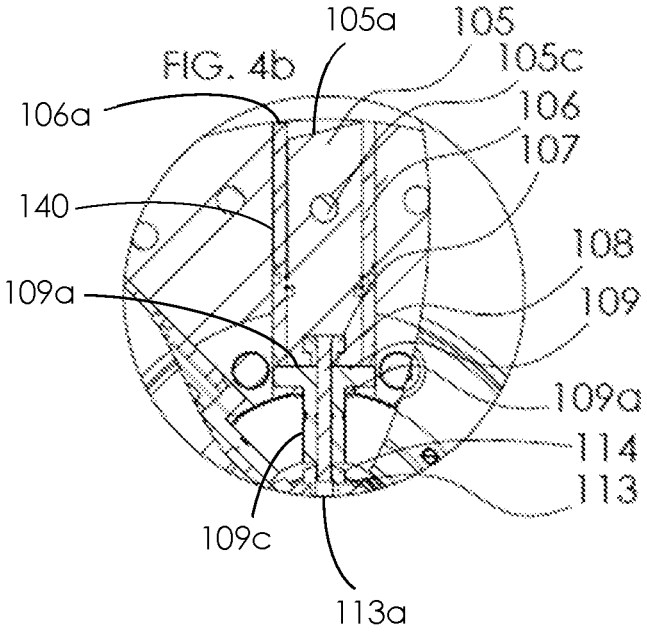
FIG. 4*b* is an enlarged illustrative cutaway view of the punch head of FIG. 4, in which the perforating sets of the punch head are in the engaged position.
Figure 4C:
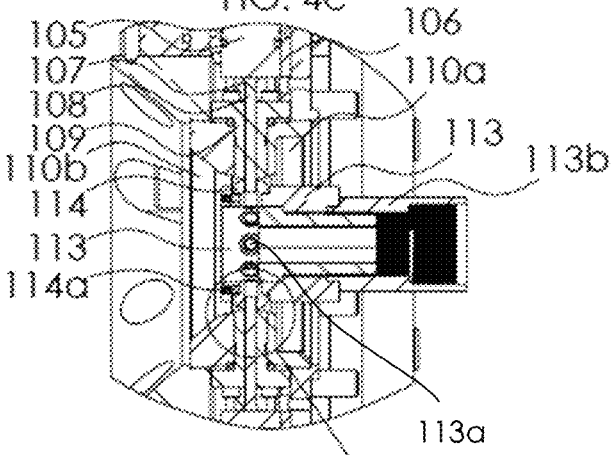
FIG. 4*c* is a cutaway view showing one form of internal die, comprising die buttons, that may be used with the tube perforating machine of the invention.
Figure 4D:
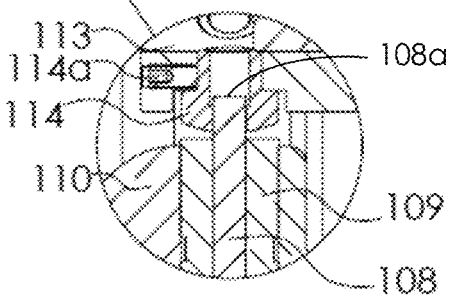
FIG. 4*d* is an enlarged detail view of 4*c*, showing the gap between the tube clamps and die where the tube is held captive.
Figure 4E:
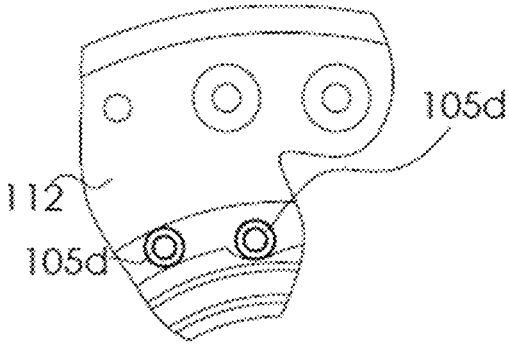
FIG. 4*e* is a schematic view of a portion of a cam profiled front plate of the punch head and cam rollers.

Preferably, the punch actuator 105 is biased toward the disengaged position in which the distal end 105*a* of the punch actuator 105 projects from the second aperture 130 of the actuator housing 140 to project beyond the peripheral surface of the actuator hub 102. In one form, the punch actuator 105 comprises a cam axle 105*c* that supports a pair of cam rollers 105*d* so that a cam roller is located on either side of the punch actuator. The cam rollers 105*d* engage with a cam profile that is machined into the front and back plates 111, 112 of the punch head 1, as shown in FIG. 4*e*, to bias the punch actuator 105 toward the disengaged position.

The punch 108 is a cutting member that is configured to project from the proximal end 105*b* of the punch actuator 105. Preferably, the punch 108 is an elongate, cutting member having a circular lateral cross-section to cut round holes within the tube 800. However, in other forms, the punch may have a semi-circular, hexagonal, star or square lateral cross-section to form hexagonal, star or square shaped holes in the tube. It is envisaged that the punch may have any regular or irregular lateral cross-sectional shape at its cutting end to achieve the desired shaped holes in the tube 800.

The actuator housing 140 also houses a clamp actuator 106. The clamp actuator 106 has a distal end 106*a* that projects through the second aperture 130 of the actuator housing 140 to extend beyond the peripheral surface of the actuator hub 102 when in a disengaged position. The clamp actuator 106 also comprises a proximal end 106*b* that is configured to engage with a tube clamp 109 located within the actuator housing 140. In one form, the clamp actuator 106 may be attached to the tube clamp 109 or may be integrally formed with the tube clamp 109. In another form, the clamp actuator 106 may configured to press against the tube clamp 109 to hold the tube clamp in an engaged/clamping position, and to release contact with the tube clamp when the tube clamp 109 and clamp actuator 106 are in a disengaged position.

In the engaged position, the clamp actuator 106 causes the tube clamp 109 to press/clamp against the outer surface of the tube held within the tube guide 110 in order to hold the tube in a fixed position. In the disengaged position, the clamp actuator 106 causes the tube clamp 109 to release contact with the tube so that the tube can be moved within the tube guide 110. The clamp actuator is preferably biased to the disengaged position by a compression member 109*a* that is located between a portion of the tube clamp 109 and the tube guide 110, as shown in FIGS. 4*a* and 4*b*. Optionally, the compression member 109*a* is a spring, such as a metal disc spring, or compressible, resilient material, such as a rubber grommet or o-ring In one form, as shown in FIGS. 4, 4*a* and 4*b*, the clamp actuator 106 comprises a bore 106*c* that extends between the proximal end 106*b* and distal end 106*a* of the clamp actuator 106 and within which the punch actuator 105 is generally concentrically located. The proximal end 106*b* of the clamp actuator comprises a first contact surface 106*e* configured to press against the associated tube clamp 109 to clamp the tube clamp against the tube 800 to be perforated.

In one embodiment, as shown in FIGS. 4*a* to 4*d*, the machine 100 may comprise an internal die 113 mounted on a mandrel 615. The internal die 113 comprises a number of bores 113*a* corresponding to the number of actuator housings 140 and optionally to the number of punches 108 where each actuator housing contains a full perforating set. Each bore 113*a* is configured to receive the cutting end 108*a* of one of the punches 108 and to also receive the slug (punched out material) of the tube 800 as the punch 108 punches through the tube 800. Thus, the diameter of each bore 113*a* generally corresponds to the diameter of the cutting end of the respective punch 108 and an allowance/clearance based on the thickness of the material of the tube 800. In some forms, the diameter of each bore 113*a* may be determined by also taking into account the material of the tube 800. For example, the bore diameter may be less for a tube made from mild steel than for a tube made from stainless steel. The die 113 may be mounted on the mandrel 615 via a connecting member 113*b*, that extends between the carriage 6 and the tube guide 110. The internal die 113 is located on the mandrel 615 so as to sit within the tube guide 110 in opposing relationship to the punches 108 held within the actuator hub 102 and so that the bores 113*a* of the die generally align with the punches 108.

As the tube 800 is clamped and punched, the inside of the tube is supported by the die 113 by providing resistance to the punches so that the tube does not dent, buckle, or otherwise deform during perforation. The die also helps to ensure that minimal burring occurs so that clean holes are formed in the tube. The tube 800 has an internal diameter and the die 113 has an external diameter that is smaller than the internal diameter of the tube 800. Preferably, the external diameter of the die 113 is only slightly smaller than the internal diameter of the tube, such as approximately 0.25 mm smaller than the internal diameter of the tube 800.

Figure 17:
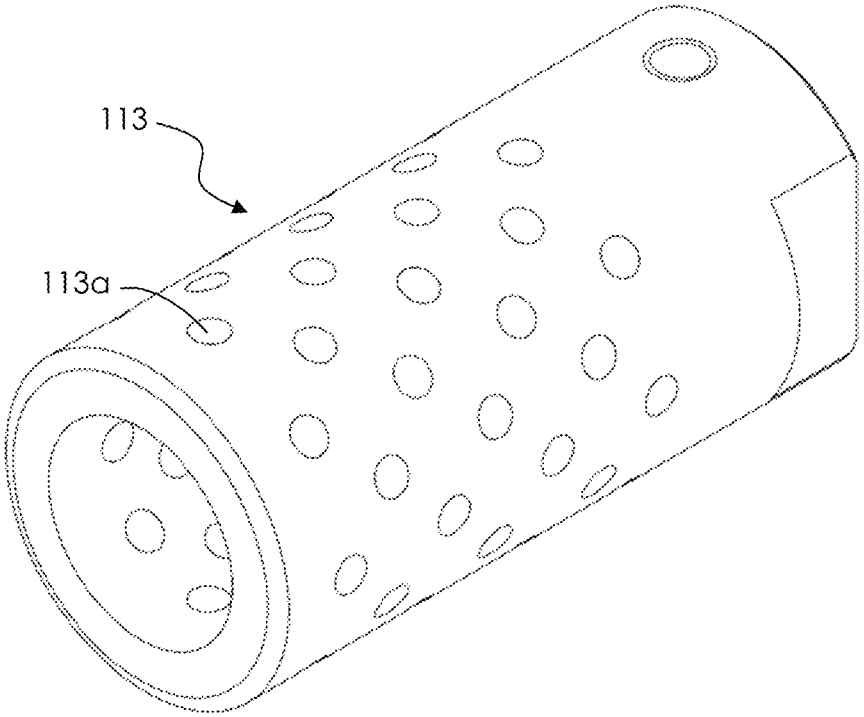
FIG. 17 is an illustrative view of one form of solid type die.
Figure 18:
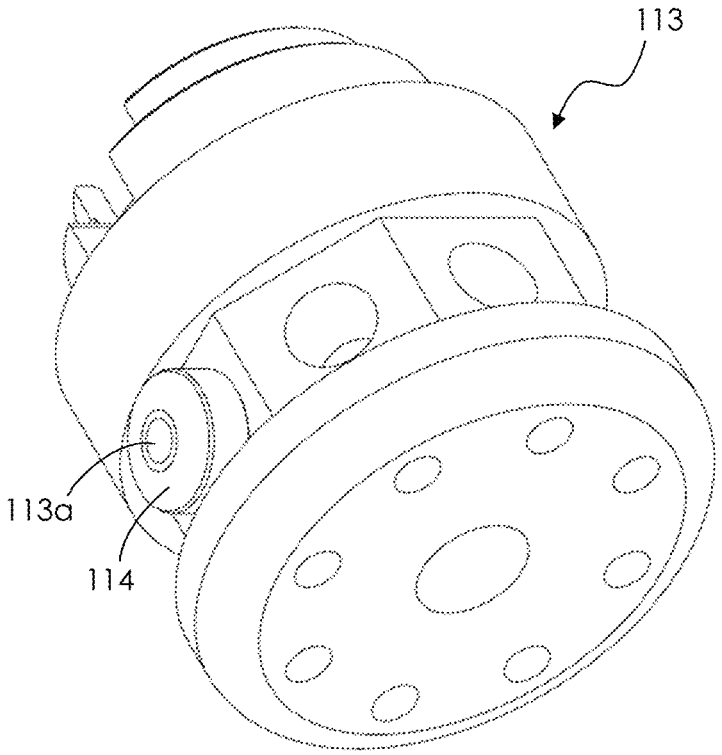
FIG. 18 is an illustrative view of one form of split type die.

The die 113 may be of any suitable form. In some forms, the die 113 is a solid type die, as shown in FIG. 17, or a 'split die' type, as shown in FIG. 18. The split die comprises die buttons 114 corresponding in number to the number of actuator housings 140 or punches 108 in the punch head 1. The die buttons 114 may be secured in place on a body of the die 113 via fastening members 114*a* such as screws. Where the die comprises die buttons 114, a bore 113*a* may be provided in each die button for receiving the cutting end of a respective punch 108 therein. An internal die 113 comprising die buttons 114 is arranged on the machine 100 to oppose the actuator housings 140 or punches 108 so as to provide resistance to the punches 108 and so that the die buttons 114 generally align with the punches 108. Such a die is useful because the die buttons are each a wear part that can be readily replaced as needed from general wear and tear. Similarly, a solid internal die 113 generally has multiple rows of punch receiving bores 113 to increase the tool life of the die. In this arrangement, as one row of bores 113*a* wears down, the next row of bores 113 can be used without needing to replace the die. The die 113 supports the tube 800 internally by providing resistance to the punches 108, while the bore 113*a* in the die button 113*a* or internal die 113 receives the cutting end of the punch 108 and cut out material of the tube 800 to enable an accurately sized perforation to be punched cleanly.

The tube clamps 109 are each located in a respective actuator housing 140 and are configured to at least partially pass through the first aperture 120 of the actuator housing 140 so as to extend from the inner wall of the tube guide 110 that defines the annulus 110*a* and to press against the outer periphery of a tube 800 located in the tube guide. The tube clamps 109 are also configured to at least partially or fully retract into the respective actuator housing 140 to release the tube 800 within the tube guide 110 when the tube clamps 109 are in the disengaged position.

In one embodiment, each tube clamp 109 comprises a cylindrical body comprising a distal end 109*a* and a proximal end 109*b*. The proximal end 109*b* may comprise a clamping surface configured to press against the outer peripheral surface of the tube 800. The distal end 109*a* is preferably enlarged and may form a flanged end to the tube clamp. The enlarged or flanged distal end 109*a* of the tube clamp 109 forms a clamp head having a second contact surface against which the first contact surface or proximal end 106*b* of the clamp actuator 106 may push so as to push the tube clamp toward the tube guide annulus 110*a* and press the clamping surface of the tube clamp 109 against the outer surface of a tube 800 located within the tube guide 110.

Each tube clamp 109 is configured to move between the engaged position and the disengaged position by moving longitudinally between the first and second apertures 120, 130 of the actuator housing 140. In the engaged position, the proximal, clamping end of the tube clamp 109 projects from the first aperture 120 of the actuator housing to extend into the annulus 110*a* of the tube guide 110 and press against the tube 800 to be perforated. With multiple tube clamps arranged to press against the tube from opposing directions, the tube is held firmly and concentrically within the tube guide 110. Once the tube 800 is clamped in position, it is ready to be perforated by the punches 108. After each punch has punched one hole in the tube (i.e. after a single punch stroke), each tube clamp 109 is configured to return to the disengaged position. In the disengaged position, each tube clamp 109 at least partially retracts into the actuator housing 140 to break contact with the tube 800. The machine 100 is then able to rotate the tube and/or move the tube longitudinally within the tube guide 110 or tube 800 may be removed from the machine 100.

Each tube clamp 109 comprises a bore 109*c* extending between the proximal and distal ends to provide the tube clamp with a hollow tubular interior configured to receive a portion of the associated punch 108.

At least a portion of the punch 108 projects through the opening to the clamp actuator bore 106*c* at the proximal end of the clamp actuator 106 and is generally concentrically located within the bore 109*c* of the tube clamp 109. The punch 108 is configured to move between an engaged/punch position and a disengaged/release position by moving longitudinally between the first and second openings 120, 130 of the actuator housing 140 and within the bore 106*c* of the clamp actuator 106 and the bore 109*c* of the tube clamp 109. In the engaged position, the proximal, cutting end of the punch 108 projects from the tube clamp bore 109*c* to punch into the tube 800 that is held in position by the tube clamp 109. In the disengaged position, the cutting end of the punch 108 retracts at least partially within the tube clamp 109 to pull away from the tube 800.

Between adjacent actuator housings 140, the curved outer surface of the actuator hub 102 of the punch head 1 is preferably generally smooth and uninterrupted to form what will be referred to in this specification as a 'disengaged' zone. The disengaged zones between actuator housings 140 and the rotating cam assembly 15 of the punch head work cooperate to allow the punches 108, punch actuators 105, tube clamps 109 and clamp actuators 106 to return to and remain in a disengaged position for a period of time. In effect, the arrangement provides a pause between punch strokes so that the tube may be moved further along the tube guide 110 and/or may be rotated within the tube guide before the next punch stroke occurs. Thus, the actuator hub 102 and rotating portion/rotating cam assembly 15 of the punch head provide a punch timing system that can cooperate with the Geneva timing system and linear drive assembly to disengage the punches as the tube 800 is being manipulated within the tube guide 110, such as by being rotated and/or moved longitudinally within the tube guide.

The rotating cam assembly 15 of the punch head is configured to rotate about the actuator hub and engage with the perforating sets to cause the punches 108 and tube clamps 109 to move between the engaged and disengaged positions according to a desired sequence. The rotating cam assembly rotates at a steady speed as the carriage 6 moves toward or away from the punch head and rotates the tube 800, as dictated by the Geneva drive system.

The rotating cam assembly comprises the front and rear plates 111, 112 and the ring gear 101 of the punch head 1 and also comprises a roller assembly comprising a plurality of paired rollers 103 that may be connected to the front plate 111 and the back plate 112 via a roller axle 103*a*, and bolts 103*b* from each side of the head. Each pair of rollers comprises a first roller and a second roller. The rotating cam assembly 15 of the punch head also comprises a plurality of travel rollers 104. The travel rollers 104 are located between the paired rollers 103 and the actuator hub 102 and are configured to rotate freely about the actuator hub 102. In the embodiment described above in which the tube guide 110 comprises eight perforating sets, the rotating cam assembly 15 comprises eight paired rollers 103 (16 total rollers) and eight travel rollers 104. The travel rollers rotate and travel around the peripheral surface of the stationary actuator hub 102, which is attached to the frame 10 of the machine, such as to a front plate at the front of the machine 100. Typically, the travel rollers 104 are configured to rotate and travel in a clockwise direction, but in some forms the rollers 104 may rotate anti-clockwise. The punch actuator 105 is orientated within the actuator housing so that its angled distal end 105*a* is inclined in the same direction as the direction of travel of the travel rollers 104. Therefore, if the travel rollers 104 move in a clockwise direction, the angled distal end 105*a* of the punch actuator 105 is configured to be inclined in a clockwise direction.

The rotating cam assembly 15 of the punch head 1 further comprises a sleeve in the form of a ring gear 101. The sleeve/ring gear 101 comprises an outer surface that defines both the outer peripheral surface of the rotating cam assembly 15 of the punch head body and the outer peripheral surface of the punch head 1 in its entirety. The outer surface of the ring gear 101 is configured to engage with the drive belt 202, driven by the drive wheel 201, which is powered by the motor 3. The ring gear 101 is also attached to the front and back plates 111, 112 of the punch head 1 and comprises an inner surface configured to engage with the paired rollers 103 of the rotating cam assembly 15. In this configuration, the motor 3 causes the drive wheel 201 to rotate, which in turn causes the drive belt 202 to rotate. The rotating drive belt 202 causes the ring gear 101 to rotate, which causes the front and back plates 111, 112 of the punch head 1 to rotate. As the front and back plates 111, 112 rotate, the paired rollers 103 and travel rollers 104 begin to rotate and move around the peripheral surface of the actuator hub 102.

At least one of each of the rollers in each of the paired rollers 103 presses against or otherwise engages with the associated travel roller 104, causing the travel roller 104 to rotate. Typically, the drive wheel 201, drive belt 202 and ring gear 101 will rotate in a clockwise direction, causing the travel rollers 104 to rotate in a clockwise direction and begin to travel in a clockwise direction around the periphery of the actuator hub 102. Similarly, the front and rear plates 111, 112 of the punch head 1 begin to rotate simultaneously and in the same direction as the ring gear 101. Alternatively, the drive wheel 201, drive belt 202, and ring gear 101 may rotate anti-clockwise, causing the travel rollers 104 and front and rear plates 111, 112 of the punch head 1 to rotate in the same direction.

The rotating cam assembly 15 of the punch head 1 is configured to rotate about the actuator hub 102 so that the travel rollers 104 engage with the clamp actuators 106 and the punch actuators 105 to cause the tube clamps 109 to clamp the tube 800 in position within the tube guide 110 and to then cause the punches 108 to punch holes 801 in the tube 800.

As each travel roller 104 approaches an actuator housing 140, the travel roller 104 (trapped between the paired rollers 103 and the peripheral surface of the actuator hub 102) is forced to press down on the distal end 106*a* of the clamp actuator 106 to cause the clamp actuator to move toward the first aperture 120 and therefore the annulus 110*a* of the tube guide 110. The proximal end 106*b* of the clamp actuator presses against the associated tube clamp 109, causing at least a portion of the tube clamp 109 to project from the first aperture 120 of the actuator housing 140 and press against the outer surface of the tube 800 held within the tube guide 110, as the die 113 supports the tube 800 from the inside. The tube 800 is now clamped in position within the tube guide 110.

As each travel roller 104 continues to move in the direction of travel, it begins to press against the distal end 105*a* of the punch actuator 105 that is projecting from the second opening 130 of the actuator housing 140. The distal end 105*a* of the punch actuator 105 is inclined in the direction of travel of the travel rollers 104, so that as each travel roller moves further across the inclined distal end 105*a* of the respective punch actuator, the punch actuator 105 is pushed further into the actuator housing 140. The movement of the punch actuator 105 toward the first aperture 120 of the actuator housing 140 causes the punch 108 to move in the same direction and to project from the first opening of the actuator housing 140 and from the tube clamp bore 109*c*. In this arrangement, the punch 108 projects into the tube guide annulus 110*a* where the punch 108 presses against the outer surface of the tube held within the tube guide 110. Pressure on the punch 108 steadily increases as a result of the travel roller 104 moving along and pressing against the inclined distal end 105*a* of the punch actuator 105, pushing the perforating set further toward the tube 800. The increased pressure on the punch 108 causes the punch to increase its pressure on the tube 800 until the pressure is such that the punch punches through the tube 800 to create a hole 801 in the tube.

As the travel roller 104 moves past the distal end 105*a* of the punch actuator 105, the pressure on the punch actuator 105 is released, allowing the punch actuator to return to its disengaged position in which its distal end 105*a* projects from the second aperture 130 of the actuator housing 140. Consequently, the punch 108 is simultaneously retracted from the tube 800. The clamping actuator 106 and therefore the tube clamp 109 continue to be held in the engaged/clamping position until the travel roller 104 travels past and releases contact with the distal end 106*a* of the clamp actuator 106. Once the travel roller 104 moves past the clamp actuator 106, the clamp actuator returns to its disengaged position in which its distal end projects from the second aperture 130 of the actuator housing 140. The tube clamp 109 simultaneously moves toward the second aperture 130 of the actuator housing 140 to release contact with the tube 800. The tube is now able to be moved radially and linearly within the tube guide 110.

The paired rollers 103, travel rollers 104 and perforating sets are each positioned and configured so that the punches 108 of the perforating sets are each caused to punch through the tube 800 simultaneously in a single punch stroke to form a set, row or ring of holes around the circumference of the tube. Where the punch head 1 comprises only two perforating sets, only two holes may be formed in each row/set/ring of holes. Where the punch head comprises eight perforating sets, eight holes may be formed in each row/set/ring of holes.

In some forms, the punch head 1 may comprise more tube clamps 109 than punches 108. For example, if only four holes 801 1 are required to be punched in each punch stroke, the punch head 1 may comprise eight tube clamps 109, clamp actuators 106 and punch actuators 105, to positively align the tube 800 in the tube guide 110, and four punches 108 and punch holders 107. Generally, all the tube clamps 109, clamp actuators 106 and also the punch actuators 105 can remain in the punch head 1, even if fewer punches 108 are needed, because the clamp actuators 106 and punch actuators 105 are not designed to be removed easily, but the punch holders 107, punches 108 and tube clamps 109 may be more easily removed by the user. Generally, regardless of the number of punches 108 used, it is preferred that all of tube clamps 109 will remain in the punch head 1 to ensure positive clamping and alignment of the tube 800 being punched.

During each punch stroke (in which each punch 108 punches a single hole 801 in the tube 800), the tube 800 must remain stationary. However, the machine 100 also allows the tube 800 to be repositioned within the tube guide 110 between punch strokes. The machine 100 comprises a mechanical timing mechanism that coordinates with the punch head to ensure that the tube is able to be moved only when the perforating sets are in the disengaged position.

The tube perforating machine 100 comprises a tube positioning system 600 comprising a carriage 6 and a chuck 601. The tube positioning system 600 is configured to adjust the position of the tube 800 radially and linearly within the tube guide 110. For example, the carriage 6 may move the tube axially/longitudinally within the tube guide 110 by moving the tube 800 toward or away from the front of the machine 100 to create additional punch holes 801 along the length of the tube. The chuck 601 may move the tube 800 radially to create different perforation patterns along the length of the tube, such as a staggered or spiral punched hole pattern. The pattern that is created along the tube depends on the linear pitch and radial pitch created by the machine set up. The linear pitch is the distance between adjacent rows/sets/rings of punched holes along the linear/longitudinal axis of the tube. FIGS. 16*a* to 16*j* show just some examples of different perforation patterns that can be created with the tube perforating machine 100 of the invention.

Figure 5:
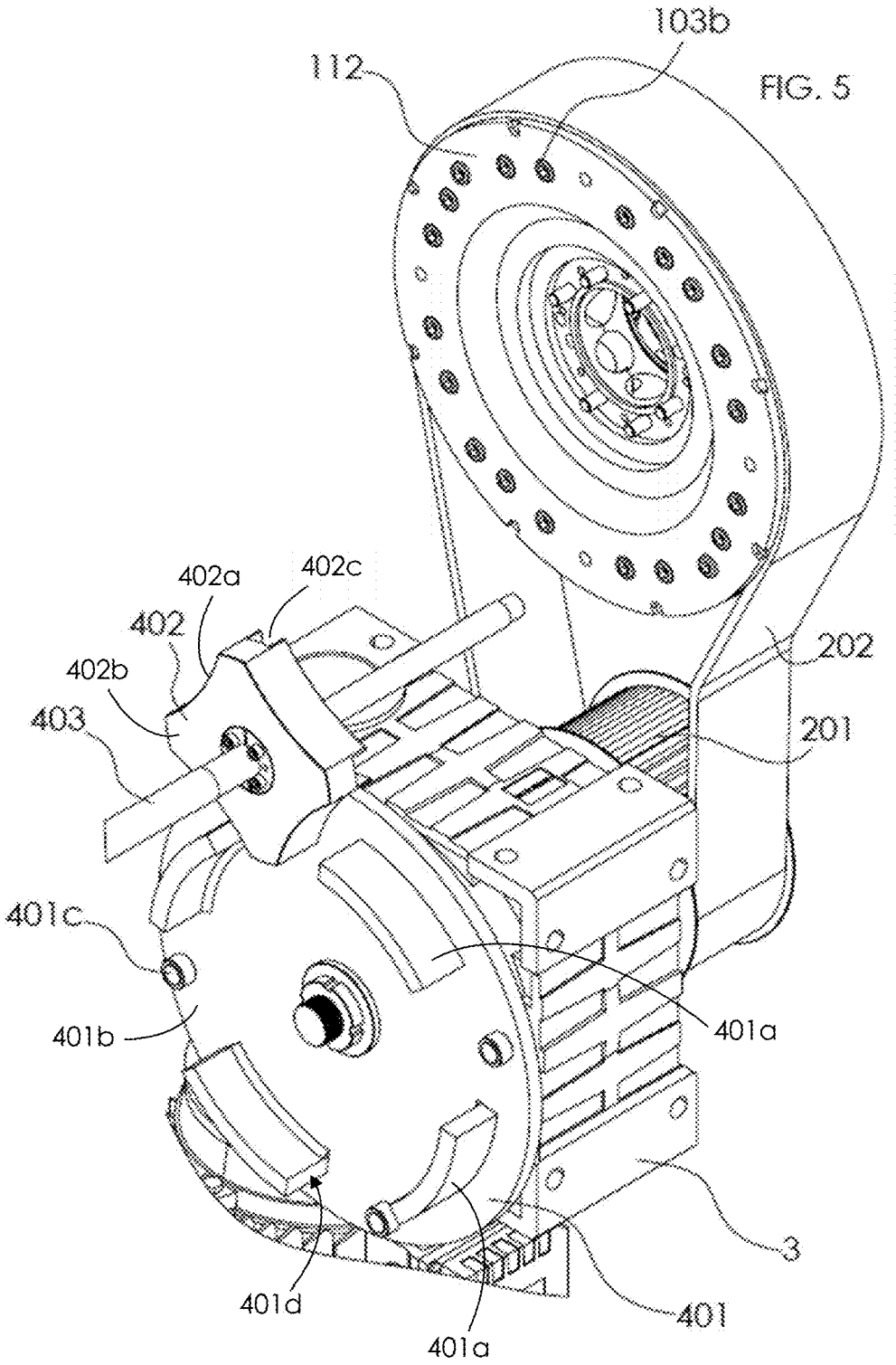
FIG. 5 is an illustrative isometric view of one form of drive system and mechanical timing system that may be used with the tube perforating machine of the invention.
Figure 6:
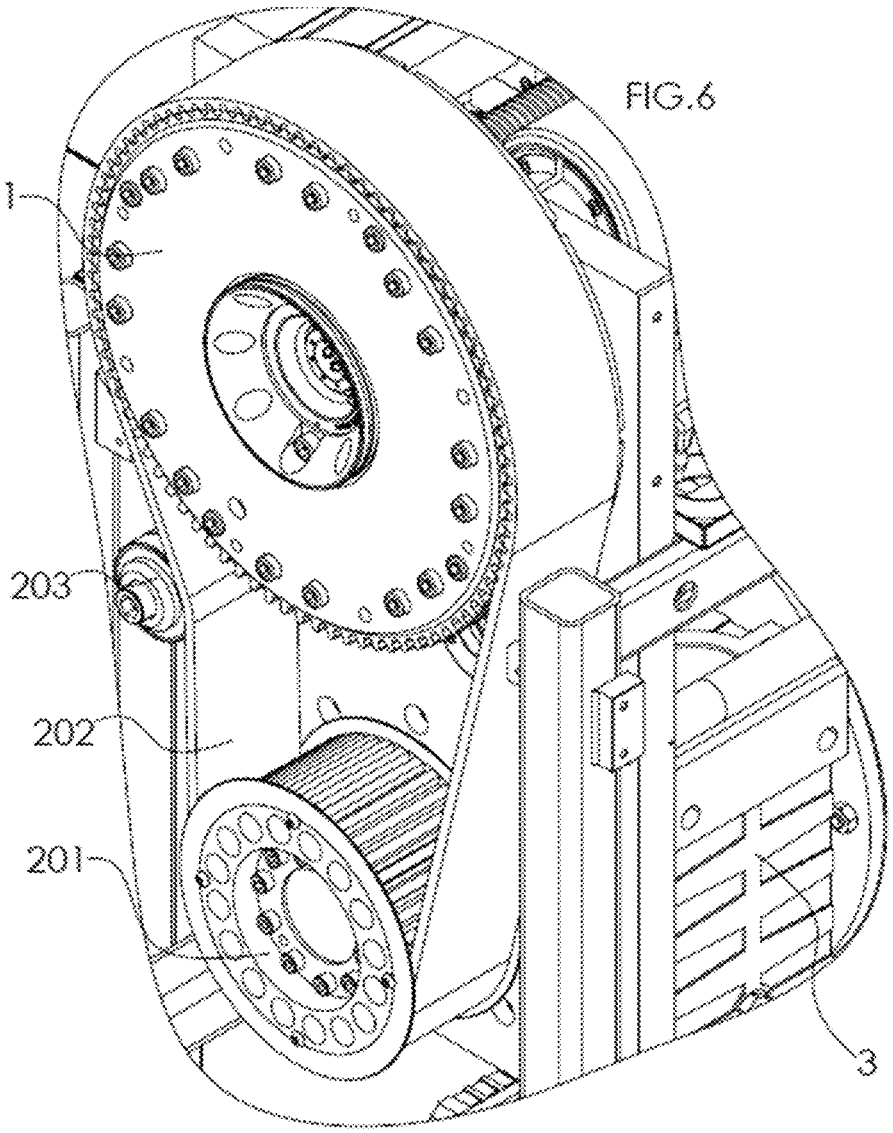
FIG. 6 is another illustrative view of the drive system shown in FIG. 5.
Figure 7:
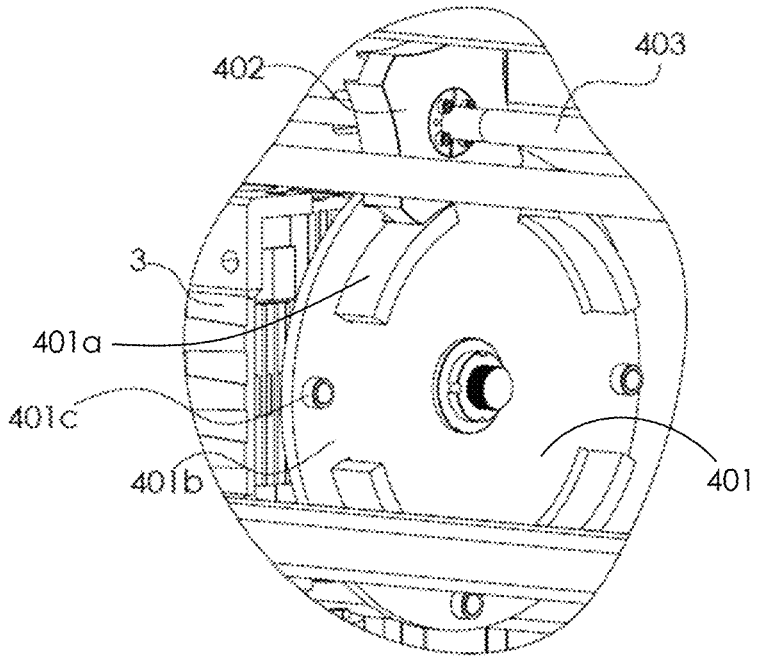
FIG. 7 is another illustrative view of the mechanical timing system shown in FIG. 5.
Figure 7A:
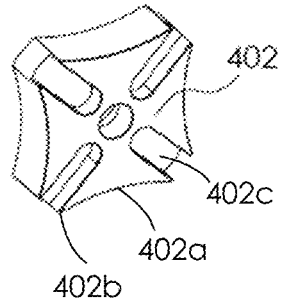
FIG. 7*a* is an illustrative view of one form of driven wheel that may be used with the mechanical timing system of the invention.

Referring now to FIGS. 5 to 7, the punch head 1 and tube positioning system 600 are operatively connected to a mechanical timing system 4 that is configured to mechanically coordinate the timing of the punch strokes by the punch head 1 with the timing of movement of the tube 800 within the tube guide 110 as a result of movement of the carriage 6 and/or a chuck 601 of the carriage.

The mechanical timing system 4 comprises a Geneva mechanism comprising a Geneva drive wheel 401 and an intermittently rotating driven wheel/member 402. The Geneva drive wheel 401 is operatively connected to the first drive wheel 201 so that rotation of the first drive wheel 201 by the motor 3 causes the Geneva drive wheel 401 (and the rotating cam assembly of the punch head 1) to rotate simultaneously. The Geneva drive wheel 401 comprises roller bearings 401*a* that engage with the driven wheel 402 to receive power from the motor 3, preferably through the gear box. Preferably, the Geneva mechanism is located at or near the back end of the machine 100 and on the other end of the gear box to the punch head 1, as shown in FIG. 5.

The Geneva drive wheel 401 comprises at least one curved bearing surface 401*a*, at least one recess or gap 401*b* within the bearing surface, and at least one engagement member 401*c*. Preferably, the drive wheel 401 comprises a plurality of curved bearing surfaces 401*a*, each bearing surface 401*a* having a gap/recess 401*b* between itself and the adjacent bearing surface 401*a*. An engagement member 401*c* may be located within each gap/recess 401*b* for engaging with the driven wheel 402. In one form, as shown best in FIG. 7, the Geneva drive wheel 401 comprises a first surface on which are located a plurality of bearing members 401*d* that project from the first surface. Each bearing member 401*d* has a curved outwardly facing surface. Preferably, the curved outwardly facing surface generally follows the same curvature as the peripheral edge of the drive wheel 401. The curved, outwardly facing surface of each bearing member 401*d* forms a bearing surface 401*a*. In the embodiment illustrated, the drive wheel 401 comprises four bearing members 401*d* and therefore also comprises four bearing surfaces 401*a*, four gaps 401*b* between the bearing surfaces, and four engagement members 401*c* (one engagement member being located within each gap). However, it is envisaged that the drive wheel 401 may be configured to provide any desired number of bearing surfaces 401*a* and engagement members 401*c* depending on the desired timing of the tube perforating machine 100, which may be effected by the number of actuator housings 140 in the actuator hub 102. For example, if the actuator hub 102 comprises six actuator housings 140, the driven wheel 402 may comprise three bearing surfaces 401*a*. Where the Geneva drive wheel 401 comprises multiple bearing surfaces 401*a*, a gap 401*b* is formed between each bearing surface 401*a* and an engagement member 401*c* is located in each gap 401*b*.

Other arrangements of Geneva drive wheel 401 for the mechanical timing system 4 are also envisaged. For example, in an alternative embodiment, the curved peripheral rim of the drive wheel 401 may comprise one or more recesses. The non-recessed area(s) of the rim each provide a curved bearing surface and the recessed area(s) each provide a gap in the bearing surface(s). An engagement member may be located within each gap.

In yet another embodiment, the first surface of the Geneva drive wheel 401 may comprise a single bearing member projecting from the first surface. The bearing member may comprise an outwardly facing surface that generally follows the same curvature as the peripheral edge of the drive wheel 401. The outwardly facing surface may comprise one or more openings or recesses so that the outwardly facing surface of each portion of the bearing member between the openings or recesses forms a bearing surface. The openings or recesses each form a gap between adjacent bearing surfaces. An engagement member may be located within the gap. In yet another form, using any of the Geneva drive wheel configurations described above or any other suitable configuration, the drive wheel may comprise only one bearing surface, only one gap located between ends of the bearing surface, and an engagement member located within the gap. However, in a preferred arrangement, the Geneva drive wheel comprises four bearing surfaces, four gaps between adjacent bearing surfaces, and an engagement member located in each gap, as shown in FIG. 7.

The intermittently rotating Geneva driven wheel 402 may comprise an outwardly facing surface, such as a peripheral edge, having a plurality of recessed regions 402*a*, to slide along the bearing surface(s) 401*a* of the Geneva drive wheel 401. Preferably, each recessed region is a concave or scalloped region that provides an inwardly curved recess. However, in other forms, the recessed region may be generally V-shaped or of any other suitable shape to effect intermittent rotation of the driven wheel 402. The driven wheel 402 also comprises a plurality of projections 402*b*, at least one projection being located between adjacent recessed or scalloped regions 402*a*. Each projection 402*b* is configured to project into the gap 401*b* within a bearing surface 401*a* or between adjacent bearing surfaces 401*a*. Preferably, the driven wheel 402 comprises a plurality of recessed or scalloped regions 402*a* and a projection 402*b* between each of the recessed or scalloped regions 402*a*.

The Geneva driven wheel 402 comprises radially orientated openings 402*c*, such as slots or channels. One radial opening 402*c* extends from the apex or maximum point of each projection 402*b* toward a central point of the Geneva driven wheel 402. In one form, the openings 402*c* define channels or slots located on a rear face of the driven wheel 402, the openings/channels/slots 402*c* extending from the maximum point of each projection 402*b* to a central point on the rear face of the driven wheel 402. Each opening/channel/slot 402*c* is configured to receive an engagement member 401*c* of the Geneva drive wheel 401 and to allow the engagement member 401*c* to slide along the opening/channel/slot 402*c*.

In a preferred embodiment illustrated in FIG. 7, the Geneva drive wheel 401 comprises four bearing surfaces 401*a*, four gaps 401*b* located between the bearing surfaces, and four engagement members 401*c* (one engagement member being located in each gap). The bearing surfaces 401*a*, gaps 401*b* and engagement members 401*c* are spaced generally equidistantly around the drive wheel 401. Likewise, the driven wheel 402 comprises four recessed or scalloped regions 402*a*, each being separated by four projections 402*b* that are spaced equidistant around the driven wheel 402, i.e. at 90° intervals, to form a four point driven wheel 402.

The Geneva driven wheel 402 may be of any suitable shape. In the embodiment illustrated, the driven wheel 402 is shaped similarly to a Maltese cross, having scalloped side regions 402*a* and projecting arms 402*b*. In other forms, the driven wheel may comprise a circular shape comprising scalloped regions in its peripheral edge. One or more radially orientated openings 402*c* may be provided in equidistant spacing around the periphery of the driven wheel 402 to engage with one or more engagement members 401*c* of the Geneva drive wheel 401.

The driven wheel 402 is located close to the Geneva drive wheel 401 so that the recessed or scalloped regions 402*a* of the driven wheel can slide over the bearing surface(s) 401*a* of the Geneva wheel 401 and so that the projection(s) 402*b* of the driven wheel 402 can project into the gap(s) 401*b* of the Geneva drive wheel 401. When a projection 402*b* is projecting into a gap 401*b* of the Geneva drive wheel 401, the engagement member 401*c* located within that gap 401*b* engages with the radial opening 402*c* of the projection and slides along at least a portion of the opening 402*c*. The sliding engagement of the engagement member 401*c* and driven wheel 402 causes the driven wheel 402 to rotate.

In operation, as the drive motor 3 rotates the Geneva drive wheel 401, the driven wheel 402 is caused to rotate only intermittently. In particular, when a recessed or scalloped region of the driven wheel 402 contacts and slides along a bearing surface 401*a* of the Geneva drive wheel 401, the driven wheel 402 remains stationary. However, as one of the radial openings 402*c* of the driven wheel engages with an engagement member 401*c* of the Geneva drive wheel 401 and the engagement member 401*c* slides along the opening 402*c* as the Geneva drive wheel continues to rotate, the driven wheel 402 is caused to rotate and then stop rotating when its next recessed or scalloped region 402*a* comes into contact with and slides along the following bearing surface 401*a* of the Geneva drive wheel 401.

In the embodiment shown in FIG. 7, using a Geneva drive wheel 401 having four bearing surfaces 401*a*, four gaps 401*b*, and four engagement members 401*c* and using a four point driven wheel 402, the driven wheel 402 is able to turn 360°, in four discrete 90° motions, with every 360° turn of the Geneva drive wheel 401. In this arrangement, 45° of dwell time is provided on the driven wheel 402. The punch stroke of the punch head 1 occurs during the dwell time of the driven wheel 402. As the drive wheel 401 rotates, the punches 108 and tube clamps 109 disengage from the tube 800. In this way, the Geneva mechanism provides a mechanical timing system for the tube perforating machine 100.

Figure 8:
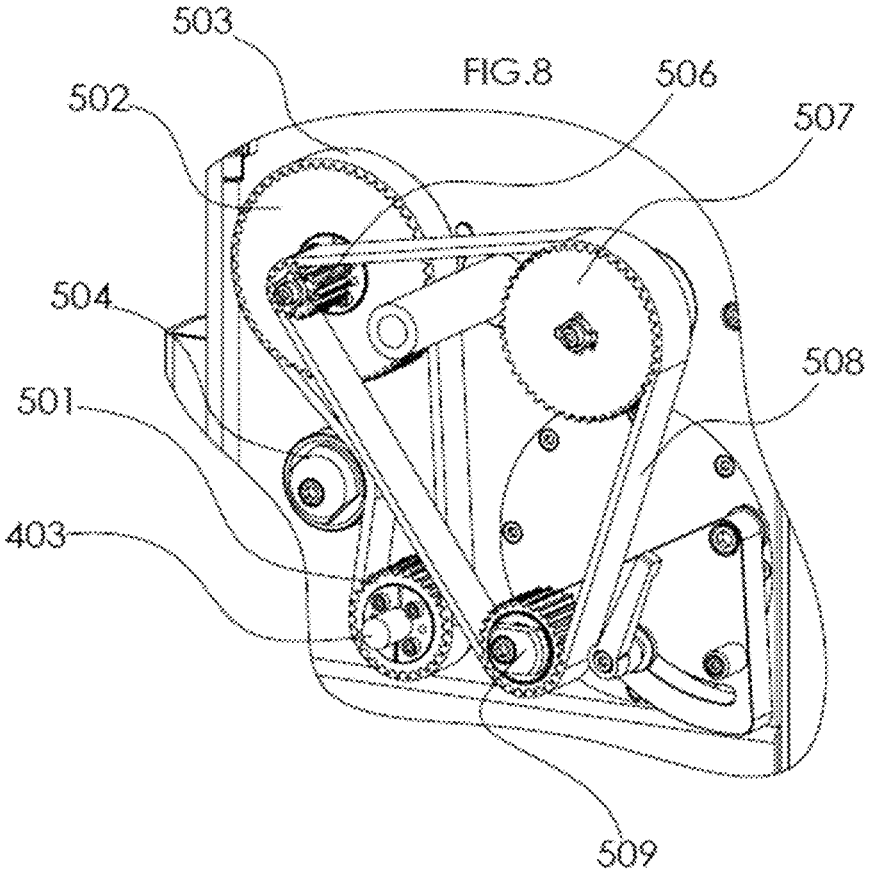
FIG. 8 is an illustrative view of one form of mechanical pitch control system that may be used with the tube perforating machine of the invention.

The Geneva driven wheel 402 is mounted on an axial drive shaft 403, as shown in FIG. 7. The axial drive shaft 403 transmits rotational motion from the driven wheel 402 to linear motion. As shown in FIG. 8, the axial drive shaft 403 forms part of an axial drive system 5 that also comprises a first pulley/radial drive pulley 501; a second pulley/radial driven pulley 502; and a radial drive belt 503, each of which may be attached to the machine frame 10, such as to the rear plate of the machine 100. The axial drive system 5 controls rotational movement of the chuck 601 that is mounted on the carriage 6 as well as the forward/back linear motion of the carriage 6.

The carriage 6 is configured to receive and hold one end of the tube 800 and to move the tube longitudinally and/or radially within the tube guide 110 of the machine 100.

In one embodiment, the carriage 6 comprises a radial adjustment system to rotate the tube within the tube guide 110. In some forms, the radial adjustment system comprises a mounting frame that supports a tube holder, such as the rotating chuck 601. The chuck 601 comprises collets 601*a* at one end to grip the tube 800 and also comprises a chuck shroud 601*b* comprising an internal tapered surface. When a tube 800 is placed within the tube perforating machine 100, the tube 100 is passed through the tube guide 110 until the far end of the tube abuts the chuck 601 mounted on the carriage 6. The collets 601*a* hold the end of the tube in place within the chuck 601. The chuck 601 is configured to rotate so as to rotate the tube 800 within the tube guide 110.

The carriage 6 may further comprise a collet drive, such as chuck air ram 606 that is operatively engaged with the collets 601*a* to clamp the collets 601*a* around the tube 800 when the ram 606 is activated. In addition, the carriage 6 comprises a chuck yoke 607 that operatively connects the chuck air ram 606 to a chuck ram shaft 609 that projects into the chuck shroud 601*b*. The chuck yoke 607 comprises opposing first and second ends and pivots about a yoke pivot 608, which is preferably mounted on the carriage 6. The second end of the yoke 607 is attached to or engages with a chuck ram shaft 609 via two or more circular bearing members 607*a*.

The carriage 6 also comprises a linear adjustment system to move the tube longitudinally or linearly within the tube guide 110. In some forms, the linear adjustment system comprises a linear actuator driver that operatively engages a linear actuator 603 to move the carriage 6, and therefore the tube 800, longitudinally. In some forms, the linear actuator comprises a ball screw 603 and the linear actuator driver comprises a ball screw air ram 605. The ball screw 603 extends generally parallel to the tube 800 and generally perpendicular to the annulus 110*a* of the tube guide 110. In this arrangement, the air ram 605 may be configured to operatively connect to a half nut 612 that is attached to the carriage 6 and which engages with the ball screw. The half nut 612 comprises a set of pins 613 that are configured to releasably engage with grooves on a linear ball screw 603, which has a longitudinal axis that extends between the front and rear of the machine 100. By engaging with the ball screw 603, the half nut 612 is able to move along the ball screw, causing the carriage 6, holding the tube 800, to move along the length of the ball screw 603, and therefore along the length of the machine 100, simultaneously. By rotating the ball screw 603 in one direction, the carriage 6 is caused to move toward or away from the punch head 1. Thus, the tube 800 is also caused to move toward or away from the punch head 1.

The air rams 605, 606 may be connected to a solenoid valve that controls air supply to the air rams.

The carriage 6 is located against a backstop 616. The carriage backstop 616 sets the distance from the front of the tube 800 to the first row of holes 801 to be perforated. The carriage backstop 616 is mounted on the machine frame 10. In one form, the carriage backstop 616 is mounted on a mandrel 615 using a clamping handle 616*a*. The mandrel 615 is located on the machine frame 10 and the clamping handle 616*a* is configured to releasably engage the machine frame 10 to lock the backstop 616 in a fixed position and to release the backstop so that the location of the backstop 616 can be adjusted with respect to the machine frame 10. In a preferred form, the clamping handle 616*a* is operative to rotate in one direction to clamp the backstop 616 in a desired position on the frame and to rotate in an opposite direction to release the backstop 616 and allow the backstop position to be adjusted for the next tube. In effect, by releasing the clamping force of the clamping handle 616*a* against the machine frame 10, the position of the backstop 616 may be selectively adjusted to selectively adjust the position of the carriage 6 and therefore to adjust the location along the tube 800 at which the perforations should begin.

Figure 9:
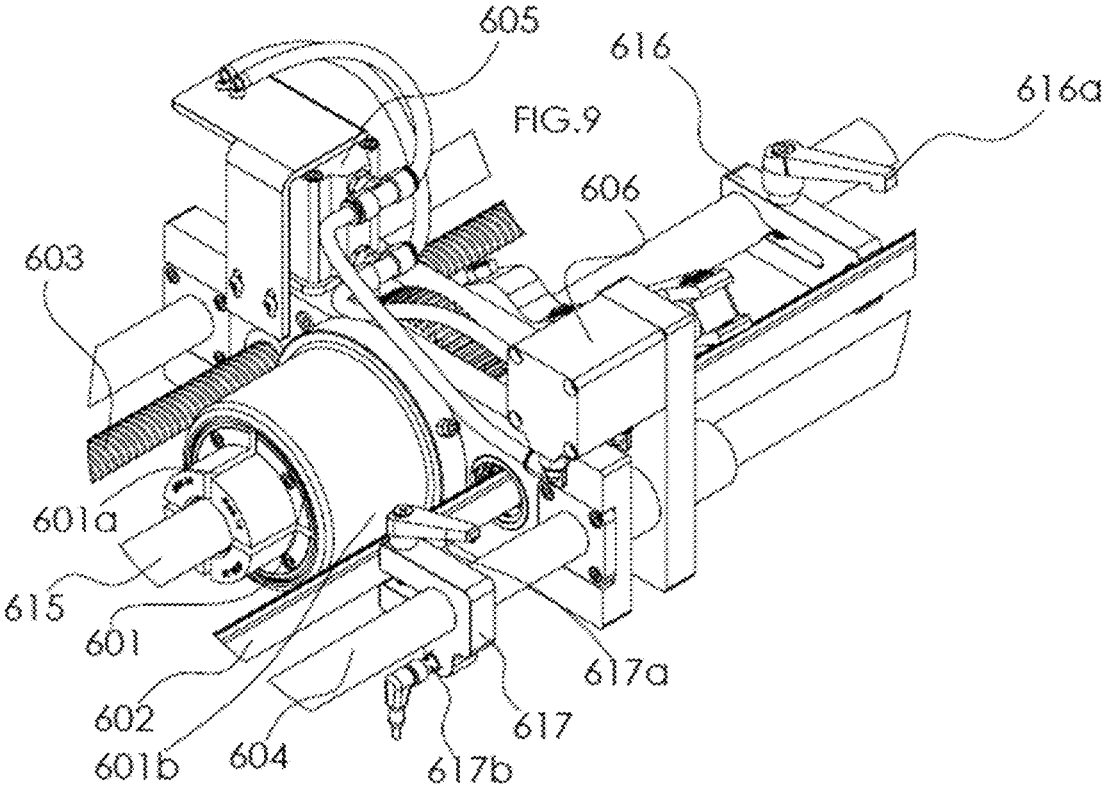
FIG. 9 is an illustrative view of one form of carriage that may be used to position a tube within the tube perforating machine of the invention.
Figure 10:
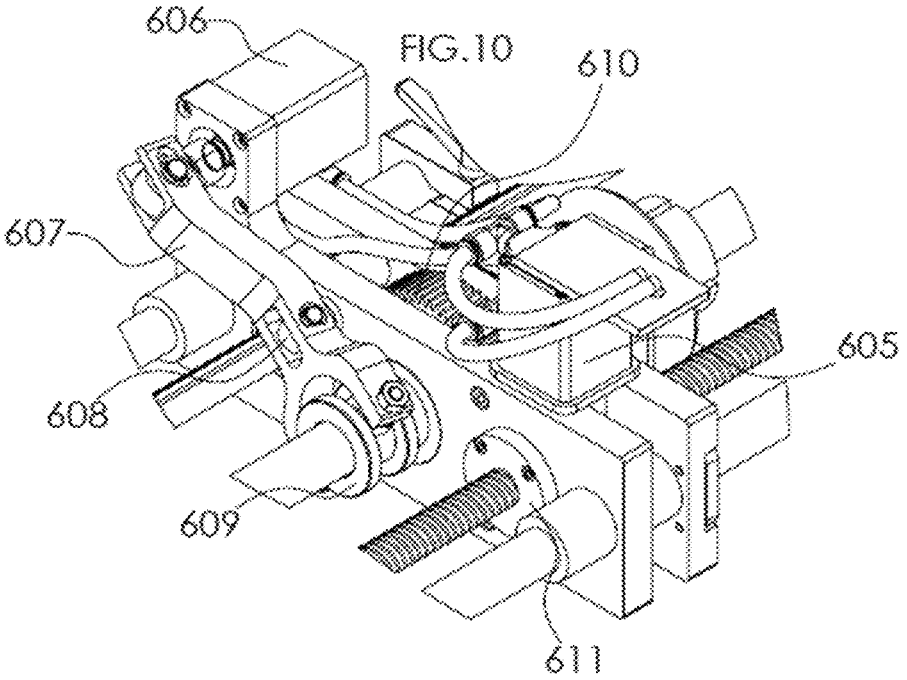
FIG. 10 is another view of the carriage of FIG. 9.
Figure 11:
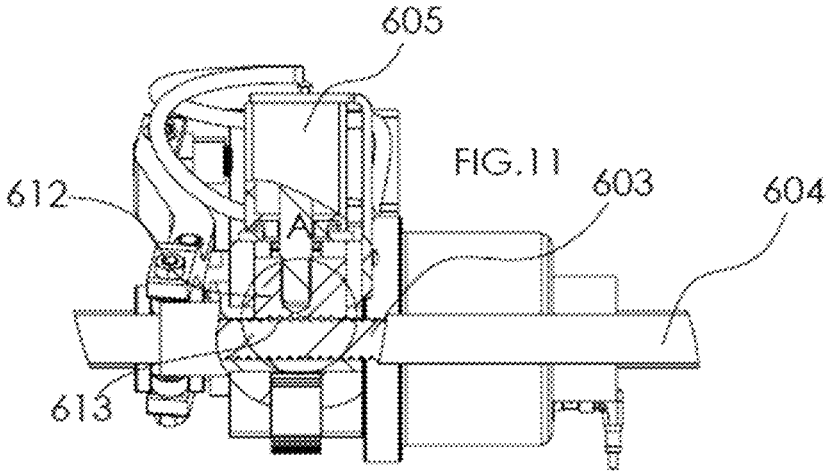
FIG. 11 is another view of the carriage of FIG. 9.
Figure 12:
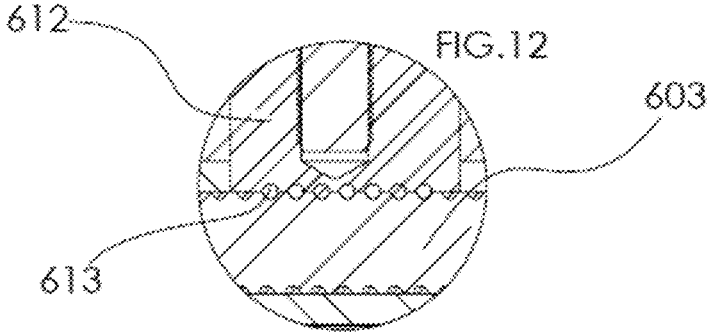
FIG. 12 is an enlarged view of area A in FIG. 11 showing pins of the half nut engaging with a linear actuator in the form of a ball screw of the machine.
Figure 13:
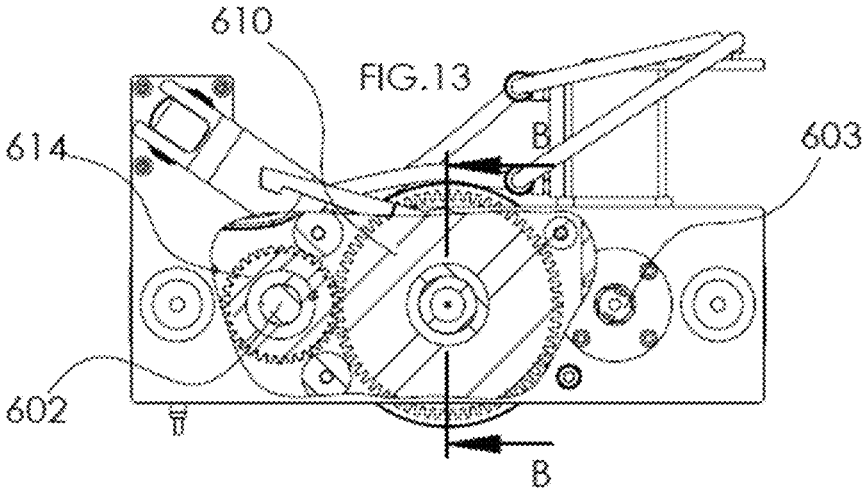
FIG. 13 is another illustrative view of the carriage of FIG. 9.
Figure 14:
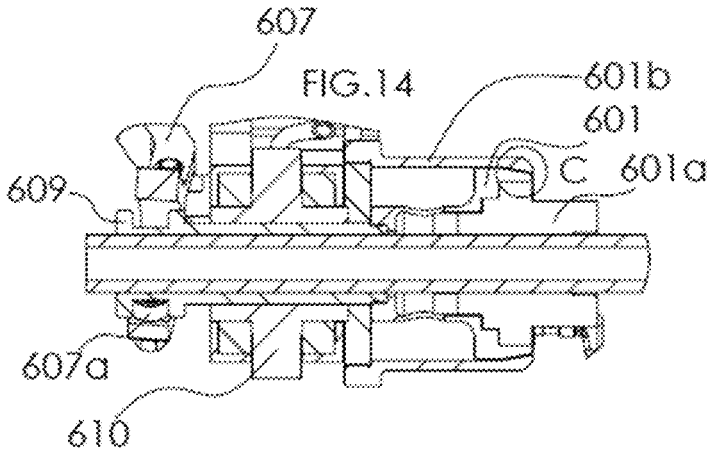
FIG. 14 is an illustrative view of the carriage from section line B in FIG. 13.
Figure 15:
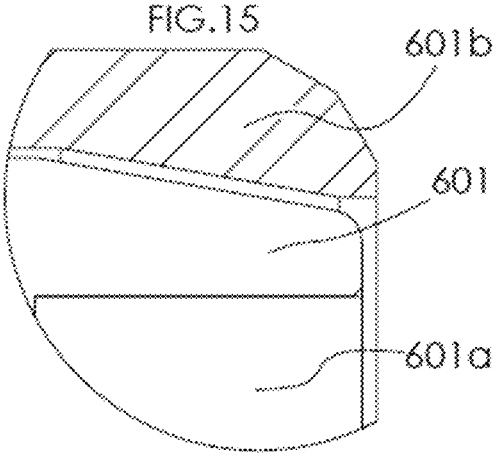
FIG. 15 is an enlarged view of area C in FIG. 14 showing the taper engagement of the chuck and chuck shroud in the disengaged position.
Figures 16A, 16B, 16C, 16D, 16E, 16F, 16G, 16H, 16I, 16J:
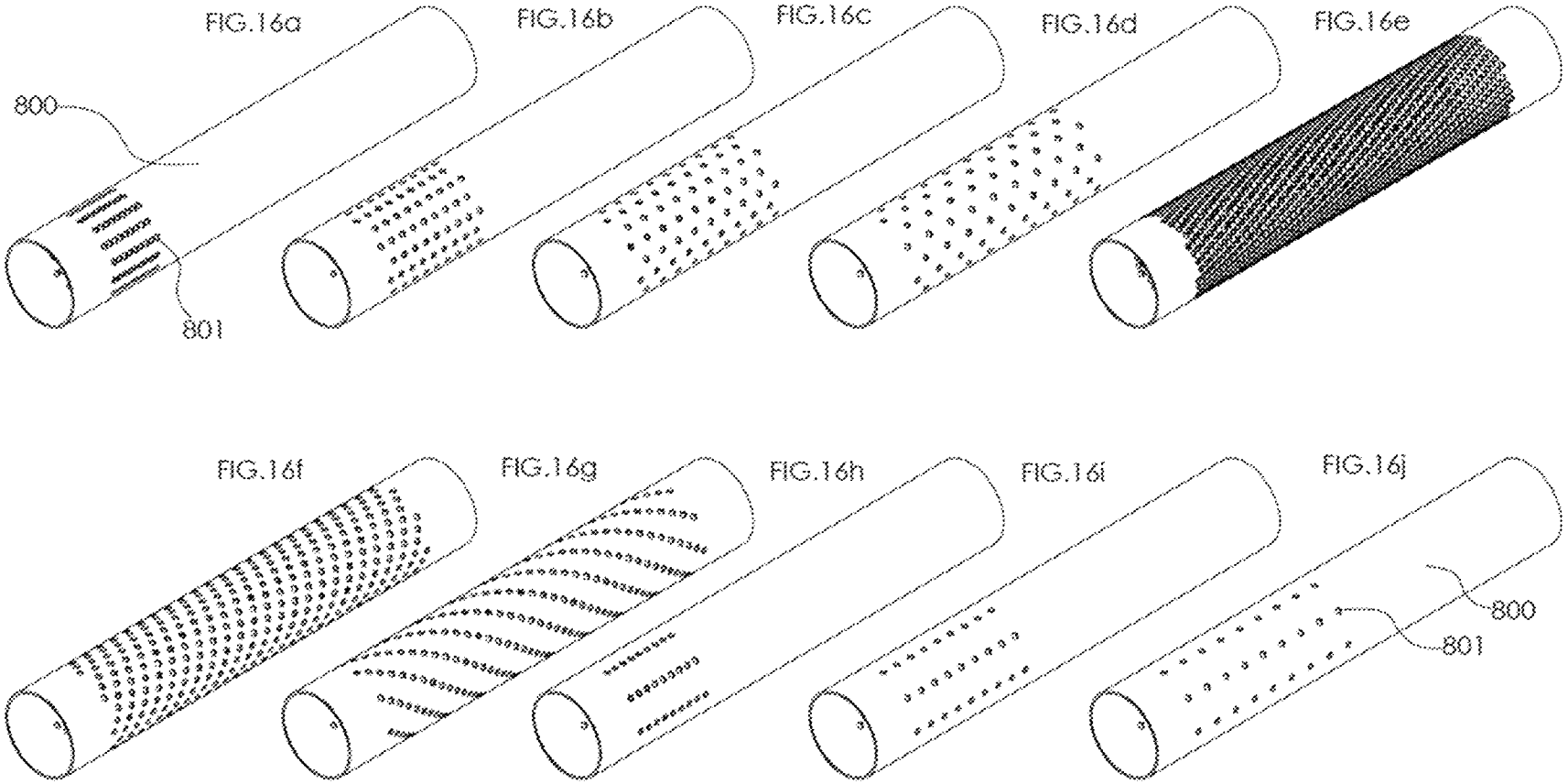
FIGS. 16*a* to 16*j* are illustrative views of various tube patterns that can be created using the tube perforating machine of the invention.

The interaction between the Geneva mechanism, the axial drive system 5 and the radial drive system with chuck 601 mounted on the carriage 6 will now be described. As the driven wheel 402 of the Geneva mechanism rotates intermittently, the first pulley 501 is simultaneously caused to rotate intermittently. The first pulley 501 is operatively connected to the second pulley/radial driven pulley 502 via the radial drive belt 503. Power is optionally transferred from the first pulley 501 to the second pulley 502 in a 2:1 ratio in order to produce a staggered pattern of perforated holes 801 in the tube 800. The second pulley 502 is operatively connected to a radial drive system 2 that engages with the carriage 6 to rotate the chuck 601, and therefore, to rotate the tube 800 held by the collets 601*a* within the chuck 601. In one form, the radial drive system 2 comprises a ball spline 602, a carriage driving gear 614 that is mounted on or otherwise connected to the carriage 6, and a carriage driven gear 610 that engages with the chuck 601. The second pulley 502 is operatively connected to the ball spline 602, such as via a taper locking bush, as shown in FIG. 9, which engages with the carriage driving gear 614 of the carriage 6. The driving gear 614 is configured to engage with the carriage driven gear 610. In the embodiment illustrated, the driven gear 610 engages with the chuck to create a 22.5° rotation of the chuck for every 90° rotation of the radial drive pulley. However, the degree of rotation of the chuck may vary depending on the configuration of the Geneva mechanism, such as the number of bearing surfaces of the driven wheel 402. The ability to rotate the tube 800 within the tube guide 110 enables the machine 100 to perforate the tube 800 in a staggered or spiral pattern of punched holes 801, depending on the linear pitch and radial pitch of the machine 100. The radial pitch is set by the radial pulley ratio of the machine 100.

The tube perforating machine 100 may also be configured to allow the linear pitch to be mechanically adjusted using the axial drive system 5, which is configured to move the carriage 6 toward the tube guide 110. The carriage 6 is mounted on a carriage frame 60 and is able to move along a portion of the carriage frame 60 between the front and back of the machine 100. In one form the carriage 6 is mounted on a carriage frame 60 comprising two guide members 604. The guide members 604 may be bolted to the machine 100, such as to the front and back plates of the machine 100, which are in turn bolted to the machine frame 10. The axial drive system 5 is configured to cause the carriage 6 to move along the guide members 604 in order to move the tube 800 longitudinally/linearly within the tube guide 110.

The axial drive system 5 comprises a linear drive pulley/third pulley 506, a linear driven pulley/fourth pulley 507 and a linear drive belt 508. Both the linear drive pulley 506 and the linear driven pulley 507 are interchangeable with pulleys having different diameters and consequently different tooth counts in order to change the linear pitch of the machine 100. The smaller the driven pulley 507 is compared to the drive pulley 506, the greater the linear distance between each set of perforated holes 801. The machine 100 may also comprise a tensioner 509, which can be used to adjust the tension on the linear drive belt 509 so that the same linear drive belt 508 can be used with linear pulleys 506, 507 having different diameters and tooth counts.

To move the carriage 6 along the carriage frame 60, in order to move the tube 800 longitudinally within the tube guide 110, the linear driven pulley 507 engages with and drives the ball screw 603, causing the ball screw to rotate about its longitudinal axis. As the ball screw rotates in a desired direction and the half nut 612 engages with the ball screw 603, the carriage 6 is caused to move along the length of the ball screw 603. In a preferred configuration, the ball screw 603 and carriage 6 are configured so that as the ball screw 603 rotates, the carriage 6 is caused to move forward toward the tube guide 110.

In one embodiment, the pitch of the ball screw 603 is 25 mm, so that one full rotation of the ball screw causes the carriage 6 to move 25 mm. By selecting different sized linear pulleys 506, 507, it is possible to enable pitches of 1 to 10 mm to be produced. Typically, desired pitches can be selected in 1 mm increments.

In use, a hollow tube 800 to be perforated is selected. Typically, the tube is metal. A user will follow a tube specification that has been set for the tube. The tube specification will specify, among other criteria, the desired number of holes 801 to be made during each set or punch stroke, the pattern of the holes between sets (i.e. whether the holes should be staggered, spiral, aligned or otherwise), the distance between holes in each set, and the start and end points of the portion of the tube 800 that is to be perforated. Based on the tube specification, a user will set the backstop 616 of the machine 100 at the required location to begin the perforations at the desired distance from the end of the tube 800. The carriage 6 is then moved to abut the backstop 616.

The tube perforating machine 100 comprises a start controller 150, such as a button or switch, that is typically mounted on the machine frame. To begin perforating a tube 800, the tube is placed within the machine 100 by sliding the tube through the annulus 110*a* of the tube guide 110 until the end of the tube 800 enters the collets 601*a*. After placing the tube 800 in the machine 100, the start controller may be activated. Upon activation of the start controller, the solenoid valve is activated which/activates energises the air rams 605, 606 on the carriage 6. When activated/energised, the air ram 605 levers the first end of the chuck yoke 607 by pushing the first end of the yoke 607. Preferably, the air ram 605 pushes the first end of the check yoke 607 away from the air ram 605 so that the chuck yoke 607 pivots about the yoke pivot 608, which causes the bearing members 607*a* within the second end of the chuck yoke 607 to press against the chuck ram shaft 609, causing the chuck ram shaft 609 to move toward the chuck 601. As the chuck ram shaft 609 moves toward the chuck 601, the chuck ram shaft 609 pushes against the internal tapered surface of the chuck shroud 601*b*, causing the collets 601*a* to come closer together and grip the tube 800. At the same time, the ball screw air ram 605 is activated/energised and applies downward pressure on the half nut 612 to engage the pins 613 of the half nut 612 with the grooves of the ball screw 603. As the pins 613 engage with the ball screw, and the linear drive pulley 506 causes the ball screw to rotate, the carriage (and therefore the tube) is caused to move forward along the ball screw 603.

When the tube 800 is held within the chuck 601 of the carriage 6, the motor 3 is powered on to cause the rotating cam assembly 15 of the punch head 1 to begin to rotate. As the travel rollers 104 of the rotating cam assembly 15 press against the tube clamp actuators 106, the tube clamps 109 are caused to move to the engaged position and the portion of the tube 800 located within the tube guide 110 is clamped in position. As the travel rollers 104 press against the punch actuators 105, the punches 108 are caused to move to the engaged position and punch holes 801 in the tube 800 in a single punch stroke. The tube clamps 109 hold the tube 800 stationary within the tube guide 110 until the punches 108 retract to the disengaged position and until the travel rollers 104 move onto the disengaged zone of the contact surface of the actuator hub 102 and stop pressing against the tube clamp actuators 106. At this point, the tube clamp actuators 106 cause the tube clamps 109 to move to the disengaged position, so that the tube 800 can be rotated within the tube guide 110 by the radial drive system 2 and/or so that the tube can be moved longitudinally within the tube guide 110 by the axial drive system 5, as described above.

To return the carriage 6 to the backstop 616 after the tube 800 has been perforated as desired, the motor 3 is stopped, which causes the ball screw air ram 605 to be deactivated/de-energised, such as by sending a signal from a sensor 617*b*, such as an inductive proximity sensor, to an air solenoid of the machine 100. The sensor 617*b* may optionally be mounted to a movable sensor support 617, which may be positioned by manipulating a sensor support adapter, 617*a*, such as a lever. The position of this sensor 617*b* dictates the distance from the end of the tube to the final set of holes. One or more air solenoids of the machine 100 typically controls whether the air rams 605, 606 are energised or de-energised. Upon receiving the sensor signal, the air solenoid de-energises the linear movement air ram 605 so the ram pressure on the half nut 612 is reversed (as the half nut is actively pulled away from the ball-screw 603) allowing the half nut pins 613 to disengage from the ball screw 603. Without the pins 613 engaging with the grooves of the ball screw 603, the carriage 6 is free to slide along the guide members 604. The carriage 6 may be manually returned to the backstop 616 by a user inserting the next tube 800 through the tube guide 110 and pushing the tube 800 into the chuck 601 until the carriage 6 abuts the backstop 616.

The tube perforating machine 100 may also comprise a stop sensor, which may be located between the front of the carriage 6 and the punch head 1. In one form, the stop sensor is a carriage proximity sensor 604*a* that is mounted on a guide rod 604. The carriage stop sensor/proximity sensor 604*a* is used for setting the distance between the last row of holes 801 perforated in the tube 800 and the terminal end of the tube 800. Once the carriage 6 reaches a preselected distance from the proximity sensor 604*a* (such as 4 mm away, for example) a signal is sent from the proximity sensor 604*a* to a first relay, which will cut power to the motor 3. The motor may be braked so that the motor 3 and punch head 1 stop almost instantaneously. Once the motor 3 has stopped, a short pause may occur before a signal from the first relay or from a second relay (such as a time delay relay) will be sent to an air solenoid of the machine 100 to de-energise the air rams 605 and 606. By de-energising the air rams 605, 606, the collets of the chuck 601 release the grip on the tube 800 so that the tube is able to be pulled out of the chuck 601. Once the air rams 605, 606 are deactivated, the half nut 612 disengages from the ball screw 603, allowing the carriage 6 to be slid back to the backstop 616 when a new tube 800 is inserted into the machine 100.

In the configuration where the punch head 1 comprises eight perforating sets, a punch hole 801 occurs every 45°. Each 360° rotation of the punch head 1 results in eight punch strokes of eight punches, equalling 48 punch holes 801 in the tube. If the drive wheel 201 and the ring gear 101 are in a 2:1 ratio, a punch stroke will occur for every 90° rotation of the drive motor 3. The Geneva mechanism is configured to time the operations of the machine so that the dwell period (in which the driven wheel 402 does not rotate) occurs while the punch stroke is taking place. Once the tube clamps 109 and punches 108 are disengaged after a punch stroke, the driven wheel 402 re-engages with the Geneva drive wheel 401, allowing the ball screw 603 to rotate to move the carriage 6 along the carriage frame 60 and toward and away from the punch head 1, thereby causing the tube 800 to move longitudinally within the tube guide 110 and optionally allowing the chuck 601, and therefore the tube 800, to rotate within the tube guide 110. Typically, the tube will rotate as it moves axially within the punch head. The Geneva mechanism therefore allows the chuck 601 to rotate and the carriage 6 to move longitudinally along the carriage frame 60 when the punches 108 and tube clamps 109 of the punch head 1 are disengaged.

If the tube specification requires the tube 800 to have straight/aligned rows of holes 801 (i.e. where the holes are not in a staggered or spiral pattern along the length of the tube), radial drive pulley 501 and the radial driven pulley 502 are selected so as to rotate in a 2:1 or 1:1 ratio. With radial drive pulleys in this configuration and with the punch head 1 comprising eight actuator housings 140 and eight punches 108 spaced 45° apart, the tube 800 will rotate 45° between each punch stroke to create eight straight rows of holes 801.

Preferred embodiments of the invention have been described by way of example only and modifications may be made thereto without departing from the scope of the invention.

The invention claimed is:

1. A tube perforating machine for perforating a hollow tube, wherein the machine comprises:

a. a drive motor;

b. a punch head powered by the drive motor, wherein the punch head comprises:

i. an actuator hub comprising an annulus for receiving the tube and also comprising one or more tube perforating sets, each tube perforating set comprising a clamp, a clamp actuator, a punch and a punch actuator, wherein each tube perforating set is housed within an actuator housing located in the actuator hub, and wherein each tube perforating set is able to move between an engaged position in which the clamp presses against the tube when located in the annulus and the punch punches through the tube, and a disengaged position in which the clamp and punch both release contact with the tube;

ii. a rotating portion comprising an annulus within which the actuator hub is received, wherein the rotating portion is configured to engage and disengage with the clamp actuator and punch actuator to move the clamp and punch between the engaged and disengaged positions;

c. an axial drive system comprising a carriage on which the tube is mounted; and d. a timing system powered by the motor and comprising a Geneva mechanism operatively connected to the carriage to move the carriage toward and away from the punch head when each perforating set is in the disengaged position.

2. The tube perforating machine of claim 1, wherein the annulus of the actuator hub comprises a replaceable tube guide.

3. The tube perforating machine of claim 2, wherein the actuator housing(s) is/are each defined by a first aperture, provided in an inner wall of the tube guide, a second aperture provided in a circular outer peripheral surface of the actuator hub, and a hollow extending between the first and second apertures.

4. The tube perforating machine of claim 1, wherein each perforating set also comprises a punch holder that holds the punch and engages with the punch actuator to move the punch between the disengaged position to the engaged position.

5. The tube perforating machine of claim 1, wherein the actuator hub comprises eight actuator housings, spaced equidistant about the actuator hub, and eight perforating sets, each set being located in a respective one of the actuator housings.

6. The tube perforating machine of claim 1 and further comprising a first drive wheel driven by the drive motor and operatively connected to a Geneva drive wheel of the Geneva mechanism to rotate the Geneva drive wheel.

7. The tube perforating machine of claim 6, wherein the Geneva mechanism also comprises a Geneva driven wheel, wherein the Geneva drive wheel comprises one or more outwardly facing curved bearing surfaces, one or more gaps located between the bearing surfaces, and an engagement member located within each of the gaps;

wherein the Geneva driven wheel comprises an outwardly facing surface comprising one or more recessed regions, a projection between adjacent recessed regions, and a radial opening that extends from a maximum point of each projection toward a central point of the Geneva driven wheel; and wherein each radial opening of the Geneva driven wheel is configured to slidingly receive one of the engagement members of the Geneva drive wheel to rotate the Geneva driven wheel when engaged with the rotating Geneva drive wheel.

8. The tube perforating machine of claim 7, wherein the radial openings define channels formed in a rear surface of the Geneva driven wheel.

9. The tube perforating machine of claim 7, wherein the Geneva drive wheel comprises four bearing surfaces, a gap between each of the bearing surfaces, and an engagement member located within each gap.

10. The tube perforating machine of claim 9, wherein the Geneva driven wheel comprises four projections and four recessed regions to form a Maltese cross shape.

11. The tube perforating machine of claim 1 and further comprising a radial drive system operatively connected to the Geneva mechanism to rotate the tube when each perforating set is in the disengaged position.

12. The tube perforating machine of claim 11, wherein the axial drive system further comprises an axial drive shaft operatively connected to the Geneva driven wheel; a radial drive pulley; a radial driven pulley; and a radial drive belt operatively connected to the radial drive pulley and the radial driven pulley to rotate the radial drive pulley and the radial driven pulley.

13. The tube perforating machine of claim 12, wherein the radial drive pulley and the radial driven pulley rotate in a 2:1 ratio.

14. The tube perforating machine of claim 12, wherein the carriage comprises a chuck to receive and hold one end of the tube.

15. The tube perforating machine of claim 14, wherein the chuck comprises a plurality of collets that clamp onto the tube to hold the tube within the chuck.

16. The tube perforating machine of claim 15, wherein the axial drive system comprises a ball spline that engages with a carriage driving gear, which engages with a carriage driven gear, which engages with the chuck to rotate the chuck as the radial drive pulley rotates.

17. The tube perforating machine of claim 16, wherein the chuck rotates 22.5° for every 90° rotation of the radial drive pulley.

18. The tube perforating machine of claim 16, wherein the chuck is able to rotate the tube when each of the tube perforating sets is in the disengaged position.

19. The tube perforating machine of claim 12, wherein the axial drive system further comprises a linear drive pulley, a linear driven pulley and a linear drive belt operatively connected to the radial driven pulley, linear drive pulley and linear driven pulley so that rotation of the radial driven pulley causes rotation of the linear drive belt and the linear drive pulley and linear driven pulley.

20. The tube perforating machine of claim 19, wherein the linear drive pulley and linear driven pulley are interchangeable with pulleys of different tooth counts to change the linear pitch of the machine.

21. The tube perforating machine of claim 19, wherein the axial drive system further comprises a ball screw having a longitudinal axis generally parallel with the tube, and wherein the ball screw engages with the linear driven pulley and is caused to rotate as the linear driven pulley rotates.

22. The tube perforating machine of claim 21, wherein the ball screw is operatively connected to the carriage such that rotation of the ball screw in one direction causes the carriage to move toward or away from the punch head.

23. The tube perforating machine of claim 1 and further comprising a carriage backstop to selectively adjust the position of the carriage in relation to the punch head.

24. The tube perforating machine of claim 1 and further comprising a proximity sensor operatively connected with the motor to cut power to the motor when the carriage reaches a predetermined distance from the punch head.

25. The tube perforating machine of claim 1, wherein the machine further comprises a die locatable within the tube and comprising one or more bores, each bore comprising a diameter that corresponds to the diameter of a cutting end of one of the punches plus a clearance based on the thickness of the material of the tube to be perforated.

* * * * *